US010082007B2

(12) United States Patent
Broussard et al.

(10) Patent No.: US 10,082,007 B2
(45) Date of Patent: Sep. 25, 2018

(54) ASSEMBLY FOR TOE-TO-HEEL GRAVEL PACKING AND REVERSE CIRCULATING EXCESS SLURRY

(71) Applicant: Weatherford Technology Holdings, LLC, Houston, TX (US)

(72) Inventors: John P. Broussard, Kingwood, TX (US); Christopher A. Hall, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 627 days.

(21) Appl. No.: 14/282,692

(22) Filed: May 20, 2014

(65) Prior Publication Data

US 2014/0251609 A1 Sep. 11, 2014

Related U.S. Application Data

(63) Continuation-in-part of application No. 12/913,981, filed on Oct. 28, 2010, now Pat. No. 8,770,290, and (Continued)

(51) Int. Cl.
*E21B 43/04* (2006.01)
*E21B 43/08* (2006.01)
(Continued)

(52) U.S. Cl.
CPC ..... *E21B 43/04* (2013.01); *E21B 33/124* (2013.01); *E21B 34/102* (2013.01);
(Continued)

(58) Field of Classification Search
CPC ..... E21B 33/12; E21B 33/124; E21B 34/14; E21B 43/04; E21B 43/045; E21B 43/08; E21B 43/12; E21B 43/14
See application file for complete search history.

(56) References Cited

U.S. PATENT DOCUMENTS 3,134,439 A 5/1964 Shields
3,963,076 A 6/1976 Winslow
(Continued)

FOREIGN PATENT DOCUMENTS

AU 672983 3/1994
EP 0588421 A1 3/1994
(Continued)

OTHER PUBLICATIONS

First Office Action in counterpart Canadian Appl. 2,892,410, dated Apr. 19, 2016, 3-pgs.
(Continued)

*Primary Examiner* — D. Andrews
*Assistant Examiner* — Tara E Schimpf
(74) *Attorney, Agent, or Firm* — Blank Rome, LLP

(57) ABSTRACT

A treatment assembly treats zones of a horizontal borehole. For example, the assembly can gravel pack a zone by delivering slurry down a workstring. The slurry exits the workstring's outlet and pass to the borehole annulus of the zone through a flow port in the assembly. The gravel in the slurry can pack the borehole in an alpha-beta wave from toe to heel, and the fluid returns from the borehole flow through a screen back into the assembly. After gravel packing, operators remove excess slurry from the workstring by reverse circulating down the assembly to carry the excess slurry uphole through the workstring. Closures on the assembly prevent the reverse circulation from communicating through the screens to the borehole annulus. Additionally, flow valves can be used on the flow ports to selectively open and close them.

8 Claims, 12 Drawing Sheets

Related U.S. Application Data a continuation-in-part of application No. 13/670,125, filed on Nov. 6, 2012, now abandoned, which is a continuation-in-part of application No. 13/545,908, filed on Jul. 10, 2012, now abandoned.

(60) Provisional application No. 61/506,897, filed on Jul. 12, 2011.

(51) Int. Cl.

| | |
|---|---|
| ***E21B 43/12*** | (2006.01) |
| ***E21B 43/14*** | (2006.01) |
| ***E21B 33/124*** | (2006.01) |
| ***E21B 34/10*** | (2006.01) |
| *E21B 34/00* | (2006.01) |

(52) U.S. Cl.

CPC ..... *E21B 43/045* (2013.01); *E21B 43/08* (2013.01); *E21B 43/12* (2013.01); *E21B 43/14* (2013.01); *E21B 2034/007* (2013.01)

(56) References Cited

U.S. PATENT DOCUMENTS

| | | | | |
|---|---|---|---|---|
| 4,105,069 | A | 8/1978 | Baker | |
| 4,440,218 | A | 4/1984 | Farley | |
| 4,474,239 | A * | 10/1984 | Colomb | E21B 23/006 166/278 |
| 5,113,935 | A | 5/1992 | Jones et al. | |
| 5,181,569 | A | 1/1993 | McCoy et al. | |
| 5,269,375 | A | 12/1993 | Schroeder, Jr. | |
| 5,435,393 | A | 7/1995 | Brekke et al. | |
| 5,803,179 | A | 9/1998 | Echols | |
| 5,934,376 | A | 8/1999 | Nguyen et al. | |
| 6,003,600 | A | 12/1999 | Nguyen et al. | |
| 6,253,851 | B1 | 7/2001 | Schroeder, Jr. et al. | |
| 6,371,210 | B1 | 4/2002 | Bode et al. | |
| 6,446,722 | B2 | 9/2002 | Nguyen et al. | |
| 6,464,006 | B2 | 10/2002 | Womble | |
| 6,588,507 | B2 | 7/2003 | Dusterhoft et al. | |
| 6,601,646 | B2 | 8/2003 | Streich et al. | |
| 6,644,412 | B2 | 11/2003 | Bode et al. | |
| 6,675,891 | B2 | 1/2004 | Hailey, Jr. et al. | |
| 6,715,544 | B2 | 4/2004 | Gillespie et al. | |
| 6,749,023 | B2 | 6/2004 | Nguyen et al. | |
| 6,857,476 | B2 | 2/2005 | Richards | |
| 6,883,613 | B2 | 4/2005 | Bode et al. | |
| 6,983,795 | B2 | 1/2006 | Zuklic et al. | |
| 7,017,664 | B2 | 3/2006 | Walker et al. | |
| 7,147,059 | B2 | 12/2006 | Hirsch et al. | |
| 7,240,739 | B2 | 7/2007 | Schoonderbeek et al. | |
| 7,331,388 | B2 | 2/2008 | Vilela et al. | |
| 7,367,395 | B2 | 5/2008 | Vidrine et al. | |
| 7,428,924 | B2 | 9/2008 | Patel | |
| 7,469,743 | B2 | 12/2008 | Richards | |
| 7,472,750 | B2 | 1/2009 | Walker et al. | |
| 7,578,343 | B2 | 8/2009 | Augustine | |
| 7,708,068 | B2 | 5/2010 | Hailey, Jr. | |
| 7,717,178 | B2 | 5/2010 | Gaudette et al. | |
| 7,775,284 | B2 | 8/2010 | Richards et al. | |
| 7,828,067 | B2 | 11/2010 | Scott et al. | |
| 7,987,909 | B2 | 8/2011 | Pineda et al. | |
| 8,267,173 | B2 | 9/2012 | Clarkson et al. | |
| 2002/0157837 | A1 | 10/2002 | Bode et al. | |
| 2003/0000701 | A1 * | 1/2003 | Dusterhoft | E21B 43/04 166/278 |
| 2003/0000702 | A1 | 1/2003 | Streich | |
| 2003/0037925 | A1 | 2/2003 | Walker et al. | |
| 2004/0134656 | A1 | 7/2004 | Richards | |
| 2004/0154806 | A1 | 8/2004 | Bode et al. | |
| 2004/0211559 | A1 | 10/2004 | Nguyen et al. | |
| 2006/0060352 | A1 | 3/2006 | Vidrine et al. | |
| 2007/0012453 | A1 | 1/2007 | Coronado et al. | |
| 2007/0187095 | A1 | 8/2007 | Walker et al. | |
| 2007/0227727 | A1 | 10/2007 | Patel et al. | |
| 2007/0246212 | A1 | 10/2007 | Richards | |
| 2007/0246407 | A1 | 10/2007 | Richards et al. | |
| 2008/0041588 | A1 | 2/2008 | Richards et al. | |
| 2008/0099194 | A1 | 5/2008 | Clem | |
| 2008/0236843 | A1 | 10/2008 | Scott et al. | |
| 2008/0314590 | A1 | 12/2008 | Patel | |
| 2009/0000787 | A1 | 1/2009 | Hill et al. | |
| 2009/0008092 | A1 | 1/2009 | Haeberie et al. | |
| 2009/0050313 | A1 | 2/2009 | Augustine | |
| 2009/0084556 | A1 * | 4/2009 | Richards | E21B 43/086 166/329 |
| 2009/0095471 | A1 * | 4/2009 | Guignard | E21B 34/14 166/278 |
| 2009/0133875 | A1 | 5/2009 | Tibbles et al. | |
| 2009/0151925 | A1 | 6/2009 | Richards et al. | |
| 2009/0260835 | A1 * | 10/2009 | Malone | E21B 43/08 166/387 |
| 2010/0096130 | A1 | 4/2010 | Parlar et al. | |
| 2010/0108323 | A1 | 5/2010 | Wilkin | |
| 2010/0212895 | A1 | 8/2010 | Vickery et al. | |
| 2010/0263864 | A1 | 10/2010 | Chay et al. | |
| 2010/0294495 | A1 | 11/2010 | Clarkson et al. | |
| 2011/0073308 | A1 | 3/2011 | Assal et al. | |
| 2011/0147006 | A1 | 6/2011 | O'Malley et al. | |
| 2011/0180271 | A1 | 7/2011 | Brekke et al. | |
| 2012/0006563 | A1 | 1/2012 | Patel et al. | |
| 2012/0103603 | A1 | 5/2012 | Broussard et al. | |
| 2012/0103606 | A1 | 5/2012 | Van Petegem et al. | |
| 2012/0103608 | A1 | 5/2012 | van Petegem et al. | |
| 2012/0103631 | A1 | 5/2012 | Broussard et al. | |
| 2013/0000899 | A1 | 1/2013 | Broussard et al. | |
| 2013/0008652 | A1 | 1/2013 | Broussard et al. | |
| 2013/0014953 | A1 | 1/2013 | van Petegem | |
| 2013/0062066 | A1 | 3/2013 | Broussard et al. | |

FOREIGN PATENT DOCUMENTS

| | | | |
|---|---|---|---|
| EP | 2570586 | A1 | 3/2013 |
| GB | 2387401 | A | 10/2003 |
| GB | 2410762 | A | 10/2005 |
| GB | 2437641 | A | 10/2007 |
| GB | 2450589 | A | 12/2008 |
| RU | 1810500 | A1 | 4/1993 |
| RU | 2374431 | C2 | 8/2008 |
| RU | 2492313 | C2 | 9/2013 |
| SU | 1191563 | A | 11/1985 |
| WO | 9208875 | | 5/1992 |
| WO | 2005049954 | A2 | 6/2005 |
| WO | 2007126496 | | 11/2007 |
| WO | 2009103036 | | 8/2009 |
| WO | 2013103785 | A2 | 7/2013 |

OTHER PUBLICATIONS

Examination Report No. 1 in counterpart Australian Appl. 2015202733, dated Feb. 16, 2016, 5-pgs.

Search Report in counterpart EP Appl. 15168402.4, dated Dec. 2, 2015, 8-pgs.

Decision on Grant in counterpart Russian Appl. 2015119031/03, dated May 20, 2016, 20-pgs.

Aadnoy, Bernt S, "Autonomous Flow Control Valve or "intelligent" ICD," (c) 2008, 9 pages.

Birchenko, Vasily Mihailovich, "Analytical Modelling of Wells with Inflow Control Devices," Jul. 2010, pp. 1-134, Institute of Petroleum Engineering Heriot-Watt University.

Halliburton, "EquiFlow Inflow Control Devices and EquiFlow Inject System," obtained from www.halliburton.com, (c) 2009, 18 pages.

Halliburton, "EquiFlow Autonomous Inflow Control Device," obtained from www.halliburton.com, (c) 2011, 22 pages.

Patent Examination Report No. 2 received in corresponding Australian application No. 2011236063, dated Dec. 20, 2013.

Decision on Grant in counterpart Russian Appl. No. 2011143515, dated Mar. 7, 2013.

First Office Action received in counterpart Canadian Appl. No. 2,755,623, dated Jun. 14, 2013.

(56) References Cited

OTHER PUBLICATIONS

First Office Action received in counterpart Australian Appl. No. 2011236063, dated May 21, 2013.
Extended Search Report received in counterpart European Appl. No. 12184724.8, dated Jan. 9, 2013.
First Office Action in counterpart Russian Appl. No. 2011143515, dated Nov. 26, 2012.
International Search Report received in corresponding PCT application No. PCT/US2012/046106, dated Sep. 14, 2012.
Schlumberger, "Alternate Path Screens," obtained from www.slb.com/oilfield, dated Jan. 2004, 4 pages.
Schlumberger, "FloRite—Inflow control device," obtained from www.slb.com/transcend, (c) 2009, 2 pages.
Halliburton, "Sand Control: Horizon Low Density, Lightweight Gravel," obtained from www.halliburton.com, (c) 2006, 2 pages.
Edment, Brian, et al., "Improvements in Horizontal Gravel Packing," Oilfield Review, Spring 2005, pp. 50-60.
Synopsis of SPE 38640 by Jones, L.G., et al., "Shunts Help Gravel Pack Horizontal Wellbores with Leakoff Problems," Journal of Petroleum Technology, Mar. 1998, pp. 68-69.
Coronado, Martin, et al., "Completing extended-reach, open-hole, horizontal well," obtained from http://www.offshore-mag.com/index/article-tools-template, generated on May 12, 2010, 5 pages.
Schlumberger, "ResFlow Inflow Control Devices and MudSolv Filtercake Removal Equalize Inflow and Restart Wells," obtained from www.slb.com/sandcontrol, (c) 2010, 2 pages.
Jensen, Rene, et al., "World's First Reverse-Port Uphill Openhole Gravel Pack with Swellable Packers," SPE 122765, 15 pages.
Weatherford, "Model 4P Retrievable Seal-Bore Packer Gravel-Pack System," obtained from www.weatherford.com, (c) 2005-2009, 2 pages.
Brannon, D.H. et al., "A Single-Trip, Dual-Zone Gravel Pack System Successfully Gravel Packs Green Canyon Area Wells, Gulf of Mexico," SPE 21670, (c) 1991, 7 pages.
Weatherford, "Hyraulic-Release Hookup Nipple Circulating Gravel-Pack System," obtained from www.weatherford.com, (c) 2005, 2 pages.
Weatherford, "Conventional Well Screens," obtained from www.weatherford.com, (c) 2004-2009, 16 pages.
Weatherford, "Model WFX Setting Tools," obtained from www.weatherford.com, (c) 2007-2008, 2 pages.
Weatherford, "Model WFX Crossover Tool," obtained from www.weatherford.com, (c) 2007-2008, 2 pages.
Weatherford, "Real Results: Completion Package Eliminates Sand Production, Enhances Reliability in Siberian Oil-Production Well," obtained from www.weatherford.com, (c) 2009, 1 page.
"Inflow Control Devices: FloReg Deploy-Assist (DA) Device," obtained from weatherford.com, (c) 2010, article No. 7429.00, 2 pages.
"Openhole Completions: ZoneSelect MultiShift Frac Sliding Sleeve," obtained from weatherford.com (c) 2009-2010, article No. 6670.01, 4 pages.
"7 Expandable Reservoir Completion," by Scott Watters, Society of Petroleum Engineers, North China Int. Section Sand Control and COmpletion Strategy Workshop, May 2008, 16 pages.
"Expandable Completion Systems," Weatherford, (c) 2005-2008, 12 pages.
"Cased-Hole Completion Services," Weatherford (c) 2007, 12 pages.
"Openhole Completion Systems," Weatherford (c) 2009, article No. 6683.00, 52 pages.
"ZoneSelect Fracturing Completion System," Weatherford (c) 2011, article No. 7925.01, 12 pages.
Weatherford, "Combating Coning by Creating Even Flow Distribution in Horizontal Sand-Control Completions," obtained from www.weatherford.com, (c) 20052008, 4 pages.
Schlumberger, "FluxRite Inflow Control Device," obtained from www.slb.com/completions, (c) 2009, 2 pages.
Halliburton, "EquiFlow Inflow Control Devices," Advanced Completions, obtained from www.halliburton.com, (c) 2009, 2 pages.
Halliburton, "EquiFlow Inject System," Advanced Completions, obtained from www.halliburton.com, (c) 2009, 2 pages.
Halliburton, "PetroGuard Mesh Screen," Sand Control Screens, obtained from www.halliburton.com, (c) 2010, 2 pages.
Halliburton, "EquiFlow Sliding Side-Door Inflow Control Device," Advanced Completions, obtained from www.halliburton.com, (c) 2011, 2 pages.
Halliburton, PetroGuard Screen and EquiFlow ICD with Remote-Open Valve, Advanced Completions, obtained from www.halliburton.com, (c) 2011, 2 pages.
The Journal of Petroleum Technology, "Novel inflow-control device extends well life," obtained from www.spe.org/jpt/2009/05/novel-inflow-control-device-extends-well-life/, May 18, 2009, 2 pages.
Schlumberger, "ResFlow Well Production Management System," obtained from www.slb.com/completions, (c) 2007, 4 pages.
Schlumberger, "ResInject Well Production Management System," obtained from www.slb.com/completions, (c) 2007, 2 pages.
Schlumberger, "Reslink—Screens and Injection and Inflow Control Devices," obtained from www.slb.com/transcend, (c) 2007, 8 pages.
Weatherford, "Retarding Water Production: Nozzle V's Channel ICD's," Jun. 30, 2009, 22 pages.
Weatherford, "MaxfloScreen with FloReg Device Improves Production by Achieving Even Flow Distribution in Offshore Openhole Well," obtained from www.weatherford.com, (c) 2008, 1 page.
Torbergsen, Hans-Emil Bensnes, "Application and Design of Passive Inflow Control Devices on the Eni Goliat Oil Producer Wells," Oct. 12, 2012, 138 pages, University of Stavanger, Faculty of Science and Technology.
Weatherford, "Maximizing Well Recovery by Creating Even Flow Distribution in Horizontal and Deviated Openhole Completions," obtained from www.weatherford.com, (c) 2005-2009, 4 pages.
Weatherford, "Conventional Well Screens," obtained from www.weatherford.com, (c) 2004-2009, pp. 1-15.
Weatherford, "Intermittent Production Now Flowing Steady with FloReg Inflow Control Devices," obtained from www.weatherford.com, (c) 2007-2008, 1 page.
Weatherford, "Well Screen Technologies," obtained from www.weatherford.com, (c) 2008, 12 pages.
Cesari, Michele, "Water/Gas Breakthrough in Horizontal Wells Analysis of the completion strategies used to mitigate the problem," Master in Petroleum Engineering 2008-09, Oct. 21, 2009, 43 pages.
Schlumberger, "Inflow Control Devices—Raising Profiles," Oilfield Review, Winter 2009/2010, vol. 4, pp. 30-37.
Baker Hughes, "Equalizer-CF Completion Solution Reduced Pay Zone Losses in Mature Field," obtained from www.bakerhughes.com, (c) 2010, 1 page.

* cited by examiner

ASSEMBLY FOR TOE-TO-HEEL GRAVEL PACKING AND REVERSE CIRCULATING EXCESS SLURRY

CROSS-REFERENCE TO RELATED APPLICATIONS

This is a continuation-in-part of U.S. application Ser. No. 12/913,981, filed 28 Oct. 2010, entitled "Gravel Pack Assembly for Bottom Up/Toe-To-Heel Packing" by Ronald van Petegem and John P. Broussard and of U.S. application Ser. No. 13/670,125, filed 6 Nov. 2012, entitled "Multi-Zoned Screened Fracturing System" by John P. Broussard, Ronald van Petegem, and Christopher A. Hall, which are both incorporated herein by reference in their entities.

BACKGROUND

Some oil and gas wells are completed in unconsolidated formations that contain loose fines and sand. When fluids are produced from these wells, the loose fines and sand can migrate with the produced fluids and can damage equipment, such electric submersible pumps (ESP) and other systems. For this reason, completions can require screens for sand control.

Horizontal wells that require sand control are typically open hole completions. In the past, stand-alone sand screens have been used predominately in these horizontal open holes. However, operators have also been using gravel packing in these horizontal open holes to deal with sand control issues. The gravel is a specially sized particulate material, such as graded sand or proppant, which is packed around the sand screen in the annulus of the borehole. The gravel acts as a filter to keep any fines and sand of the formation from migrating with produced fluids.

A prior art gravel pack system 20 illustrated in FIG. 1A extends from a packer 14 downhole from casing 12 in a borehole 10, which is a horizontal open hole. To control sand, operators attempt to fill the annulus between the assembly 20 and the borehole 10 with gravel (particulate material) by pumping slurry of fluid and gravel into the borehole 10 to pack the annulus. For the horizontal open borehole 10, operators can use an alpha-beta wave (or water packing) technique to pack the annulus. This technique uses a low-viscosity fluid, such as completion brine, to carry the gravel. The system 20 in FIG. 1A represents such an alpha-beta type.

Initially, operators position a wash pipe 40 into a screen 25 and pump the slurry of fluid and gravel down an inner workstring 45. The slurry passes through a port 32 in a crossover tool 30 and into the annulus between the screen 25 and the borehole 10. As shown, the crossover tool 30 positions immediately downhole from the gravel pack packer 14 and uphole from the screen 25. The crossover port 32 diverts the flow of the slurry from the inner workstring 45 to the annulus downhole from the packer 14. At the same time, another crossover port 34 diverts the flow of returns from the wash pipe 40 to the casing's annulus uphole from the packer 14.

As the operation commences, the slurry moves out the crossover port 32 and into the annulus. The carrying fluid in the slurry then leaks off through the formation and/or through the screen 25. However, the screen 25 prevents the gravel in the slurry from flowing into the screen 25. The fluids passing alone through the screen 25 can then return through the crossover port 34 and into the annulus above the packer 14.

As the fluid leaks off, the gravel drops out of the slurry and first packs along the low side of the borehole's annulus. The gravel collects in stages 16*a*, 16*b*, etc., which progress from the heel to the toe in what is termed an alpha wave. Because the borehole 10 is horizontal, gravitational forces dominate the formation of the alpha wave, and the gravel settles along the low side at an equilibrium height along the screen 25.

When the alpha wave of the gravel pack operation is done, the gravel then begins to collect in stages (not shown) of a beta wave. This forms along the upper side of the screen 25 starting from the toe and progressing to the heel of the screen 25. Again, the fluid carrying the gravel can pass through the screen 25 and up the wash pipe 40. To complete the beta wave, the gravel pack operation must have enough fluid velocity to maintain turbulent flow and move the gravel along the topside of the annulus. To recirculate after this point, operators have to mechanically reconfigure the crossover tool 30 to be able to washdown the pipe 40.

Although the alpha-beta technique can be economical due to the low-viscosity carrier fluid and regular types of screens that can be used, some situations may require a viscous fluid packing technique that uses an alternate path. In this technique, shunts disposed on the screen divert pumped packing slurry along the outside of the screen. FIG. 1B shows an example system 20 having shunts 50 and 52 (only two of which are shown). Typically, the shunts 50/52 for transport and packing are attached eccentrically to the screen 25. The transport shunts 50 feed the packing shunts 52 with slurry, and the slurry exits from nozzles 54 on the packing shunts 52. By using the shunts 50/52 to transport and pack the slurry, the gravel packing operation can avoid areas of high leak off in the borehole 10 that would tend to cause bridges to form and impair the gravel packing.

Prior art gravel pack assemblies 20 for both techniques of FIGS. 1A-1B have a number of challenges and difficulties. During a gravel pack operation in a horizontal well, for example, the crossover ports 32/34 may have to be reconfigured several times. During a frac pack operation, the slurry pumped at high pressure and flow rate can sometimes dehydrate within the system's crossover tool 30 and associated sliding sleeve (not shown). If severe, settled sand or dehydrated slurry can stick to service tools and can even junk the well. Additionally, the crossover tool 30 is subject to erosion during frac and gravel pack operations, and the crossover tool 30 can stick in the packer 14, which can create extremely difficult fishing jobs.

To deal with gravel packing in some openhole wells, a Reverse-Port Uphill Openhole Gravel Pack system has been developed as described in SPE 122765, entitled "World's First Reverse-Port Uphill Openhole Gravel Pack with Swellable Packers" (Jensen et al. 2009). This system allows an uphill openhole to be gravel packed using a port disposed toward the toe of the hole.

In cased hole operations, it is very common to install multiple gravel pack installations in a process referred to as "stacked packs". Each zone is addressed in a distinct operation to perforate it, install the gravel pack equipment, pump the gravel and then the process is repeated. Other multi-zone gravel pack systems have been developed that are generally referred to as single trip, multi-zone systems. These systems are of a conventional design in that they introduce slurry into the annulus outside the screen from the topside of the screen and pump fluid towards the bottom of the zone. Additionally, these systems have been specifically used for cased hole applications and have only recently been adapted for open hole applications.

The subject matter of the present disclosure is directed to overcoming, or at least reducing the effects of, one or more of the problems set forth above.

SUMMARY

A multi-zone apparatus and method are used for treating a formation. The apparatus can be used for formation treatments, such as frac operations, frac pack operation, gravel pack operations, or other operations. The apparatus includes a body (e.g., tubular structure, liner, production string, etc.) and a workstring. The body of the assembly is disposed in the borehole and defines a through-bore. One or more sections are disposed on the body, and each of the one or more sections comprises isolation element, a port, a screen, and a closure.

The isolation element disposed on the body isolates a borehole annulus around the section from the other sections. The port disposed on the body permits fluid communication between the through-bore and the borehole annulus, and the screen disposed on the body communicates with the borehole annulus. The closure disposed on the body at least preventing fluid communication from the through-bore to the screen.

The workstring defines an outlet and is manipulated in the body relative to each section. The workstring in a first mode of operation delivers the treatment from the outlet to the borehole annulus of section through the port. The workstring in a second mode of operation receives reverse circulation from the through-bore into the outlet.

In one embodiment, the port for a given one of the one or more sections is disposed toward the toe, and the screen for the given section is disposed toward the heel. During treatment, the port delivers slurry as the treatment and gravel packs the annulus of the given section from toe to heel. The screen filters the fluid returns from the slurry into the through-bore of the body.

In another embodiment, the port for a given one of the one or more sections is disposed toward the heel, and the screen for the given section is disposed toward the toe. During treatment, the port delivers slurry as the treatment and gravel packs the annulus of the given section from heel to toe. The screen filters the fluid returns from the slurry, and the section has a bypass delivering the fluid returns to the through-bore of the body uphole of the port.

In one embodiment, the port comprises a flow valve selectively operable between opened and closed conditions permitting and preventing fluid communication between the through-bore and the borehole annulus. The flow valve can include a sleeve movable in the through-bore between (a) the closed condition preventing fluid communication through the port and (b) the opened condition permitting fluid communication through the port. The workstring can be configured to at least open the flow valves of the one or more sections. For example, the workstring can have an actuating tool operable to open and close the flow valves of the one or more sections in the same trip in the through-bore.

In one embodiment, the closure is selectively operable between (a) a closed condition preventing fluid communication between the through-bore and the screen and (b) an opened condition permitting fluid communication between the through-bore and the screen. For example, the closure can include a sleeve movable in the through-bore between (a) the closed condition preventing fluid communication through at least one flow port in the body, the at least one flow port in communication with the screen, and (b) the open condition permitting fluid communication through the at least one flow port.

In another example, the closure can include a one-way valve disposed in fluid communication between the screen and the through-bore, the one-way valve in the open condition permitting fluid communication from the screen into the through-bore and in the closed condition preventing fluid communication from the through-bore to the screen.

The foregoing summary is not intended to summarize each potential embodiment or every aspect of the present disclosure.

DETAILED DESCRIPTION

Figure 1A:
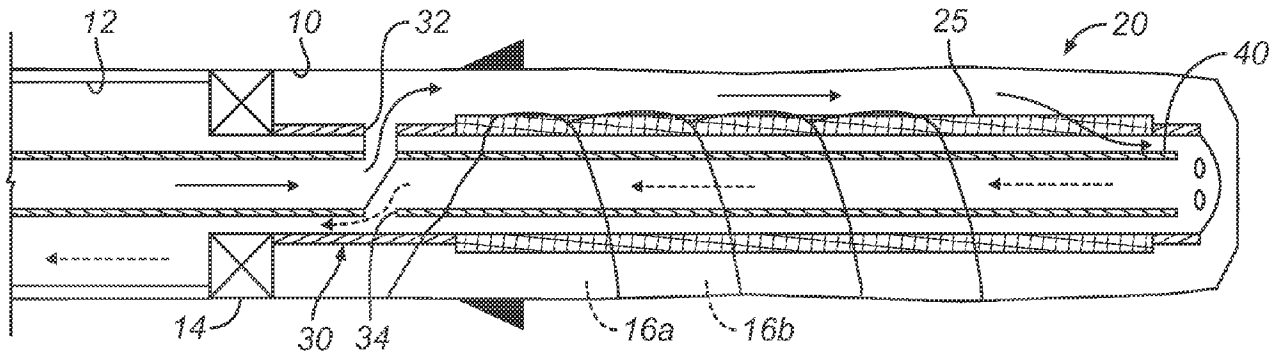
FIG. 1A (Prior Art)
FIGS. 1A-1B illustrate gravel pack assemblies according to the prior art.
Figure 1B:
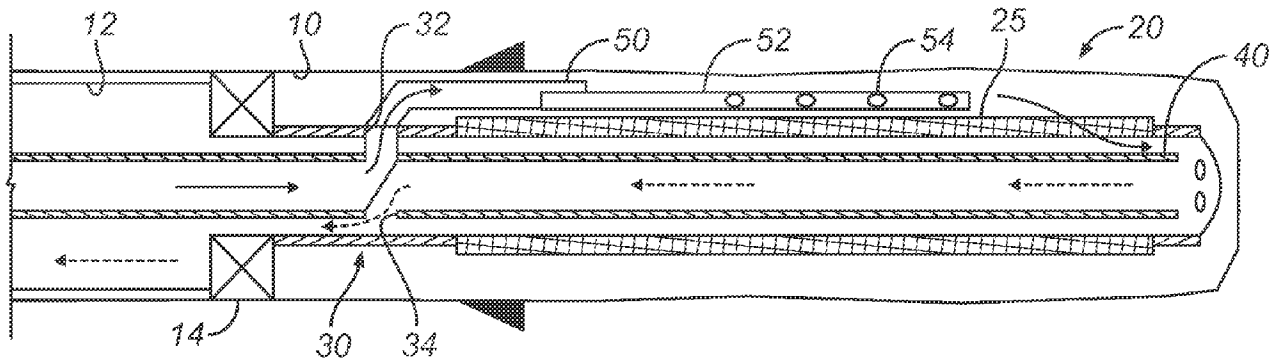
FIG. 1B (Prior Art)
Figure 2A:
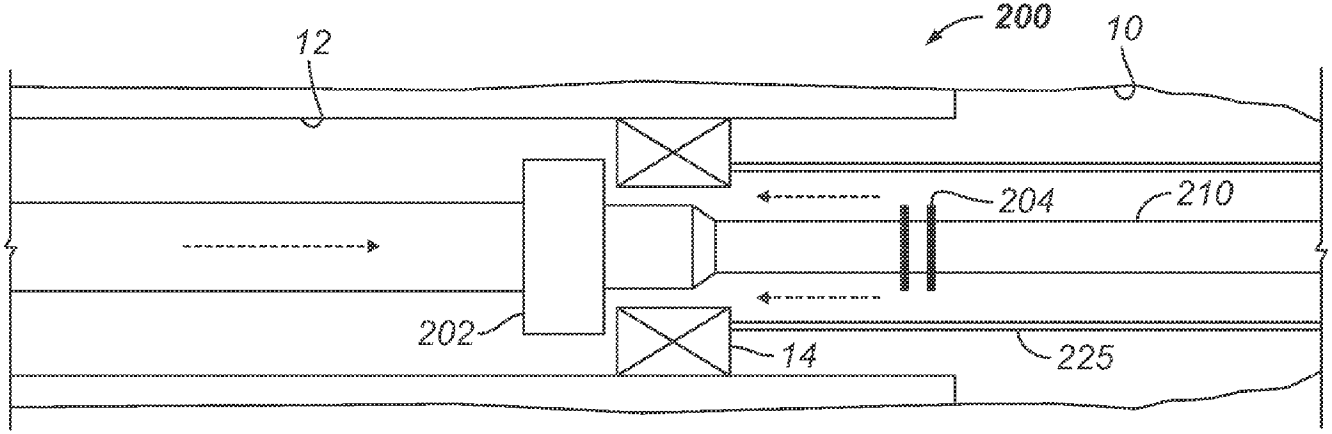
FIGS. 2A-2B show multi-zone screened system according to the present disclosure being run-in hole for a wash down operation.
Figure 2B:
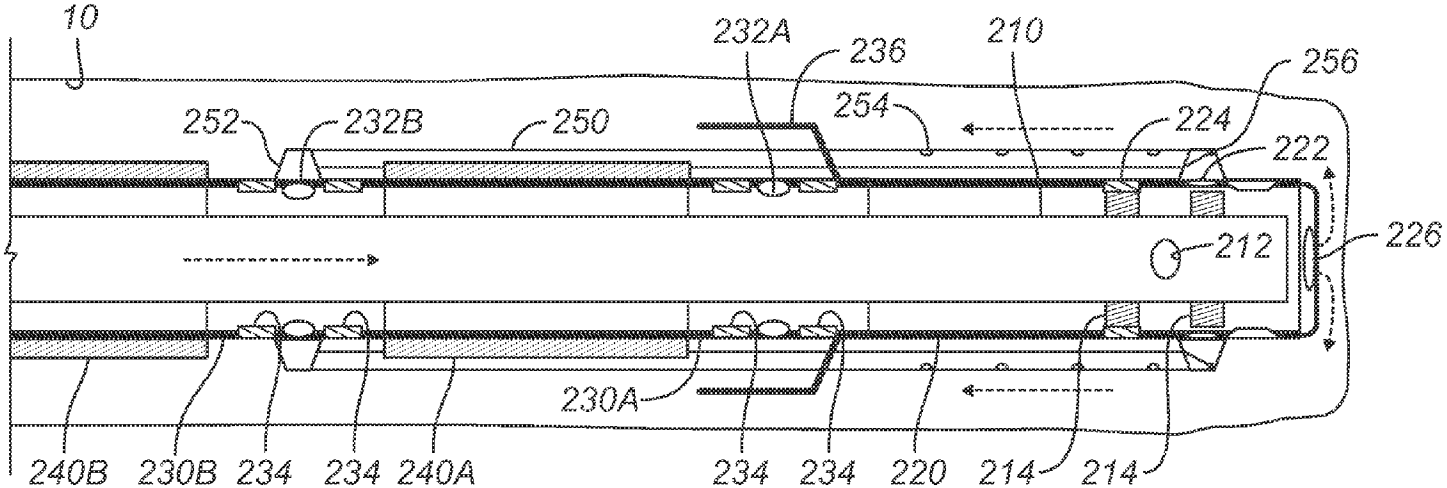

FIGS. 2A-2B show a multi-zone screened system 200 according to the present disclosure being run-in hole. The system 200 can be used for formation treatments, such as frac operations, frac pack operation, gravel pack operations, or other operations. The system 200 includes a production string or liner 225 (e.g., tubular structure or body) that extends into a borehole 10 from a liner packer 14 supported in casing 12. This borehole 10 can be a horizontal or deviated open hole. The system 200 also has a hydraulic service tool 202 made up to the packer 14 and has an inner workstring 210 made up to the service tool 202.

As shown in FIG. 2B, the liner 225 can have a float shoe 226 at its end. Meanwhile, along its length, the liner 225 can have one or more screen sections 240A-B (FIG. 2B) and one or more ported housings 230A-B. In general, the ported housings 230A-B may be disposed next to or integrated into one or more of the screen sections 240A-B. As discussed below, use of the one or more screen sections 240A-B and ported housings 230A-B provide one or more slurry packing points for a gravel packing operation.

Each of the ported housings 230A-B has body or flow ports 232A-B for diverting flow. Internally, each of the ported housings 230A-B has seats 234 defined above and below the outlet ports 232A-B for sealing with the distal end of the inner workstring 210 as discussed below. To prevent erosion, the flow ports 232A-B on the ported housings 230A-B can have a skirt, such as the skirt 236 for the flow ports 232A on the ported housings 230A.

The flow ports 232B on an upper one of the ported housings 230B communicate with alternate path devices 250 disposed along the length of the lower screen section 240A. These alternate path devices 250 can be shunts, tubes, concentrically mounted tubing, or other devices known in the art for providing an alternate path for slurry. For the purposes of the present disclosure, however, the alternate path devices 250 are referred to as shunts herein for simplicity. In general, the shunts 250 communicate from the flow ports 232B to side ports 222 toward the distal end of the system 200 or other directions for use during steps of the operation.

As shown in FIG. 2B, the inner workstring 210 extending from the service tool 202 (FIG. 2A) disposes through the screen sections 240A-B of the system 200. (The inner workstring 210 can have a reverse taper to reduce circulating pressures if desired.) On the end of the screen sections 240A-B, the system 200 has a shoe track 220 with a float shoe 226 and seat 224. The float shoe 226 has a check valve, sleeve, or the like (not shown) that allows for washing down or circulating fluid around the outside the screen sections 240A-B when running in the well and before the packer 14 is set.

On its distal end, the inner workstring 210 has outlet ports 212 isolated by seals 214. When running in, one of the seals 214 can seal the end of the inner workstring 210 inside the shoe track 220, as shown in FIG. 2B. In this way, fluid pumped downhole the inner workstring 210 can exit the check valve (not shown) in the float shoe 226 at the end of the shoe track 220 to washout the borehole 10.

During the gravel pack operations, however, the outlet ports 212 can locate and seal by the seals 214 in the ported housings 230A-B disposed between each of the screen sections 240A-B. In particular, seals 214 located on either side of the string's outlet ports 212 seal inside seats 234 on the ported housings 230A-B. The seals 214 can use elastomeric or other types of seals disposed on the inner workstring 210, and the seats 234 can be polished seats or surfaces inside the housings 230A-B to engage the seals 214. Although shown with this configuration, the reverse arrangement can be used with seals on the inside of the housings 230A-B and with seats on the inner workstring 210.

When fluid is pumped through the inner workstring 210, pumped fluid exits from the string 210 and through the flow ports 232A-B on the ported housings 230A-B depending on the location of the string 210 to the flow ports 232A-B. In this arrangement, the flow ports 232A in the lower ported housing 230A direct the slurry directly into the annulus, whereas the flow ports 232B in the upper ported housing 230B direct the slurry into shunts 250 as discussed below. Other similar arrangements can be used. In any event, this selective location and sealing between the string 210 and housings 230A-B changes fluid paths for the delivery of slurry into the annulus around the screen sections 240A-B during the gravel pack operations discussed in more detail below.

As shown in FIGS. 2A-2B, the system 200 is run-in hole for wash down. The service tool 202 sits on the unset packer 14 in the casing 12, and seals 204 on the service tool 202 do not seal in the packer 14 to allow for transmission of hydrostatic pressure. The distal end of the inner workstring 210 fits through the screen sections 240A-B, and one of the string's seals 214 seals against the seat 224 near the float shoe 226. Operators circulate fluid down the inner workstring 210, and the circulated fluid flows out the check valve in the float shoe 226, up the annulus, and around the unset packer 14.

Figure 3A:
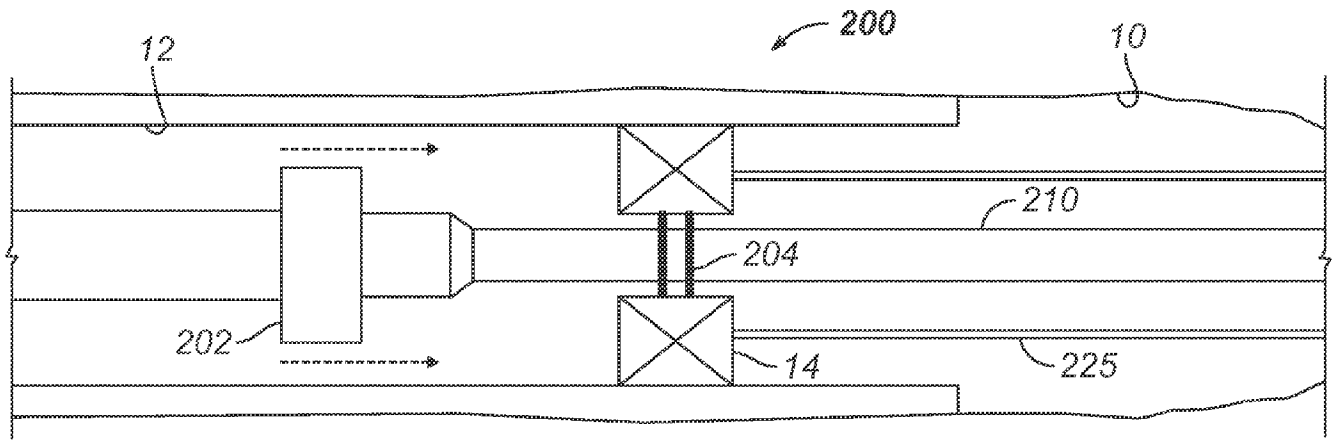
FIGS. 3A-3B show the system during setting and testing of the packer.
Figure 3B:
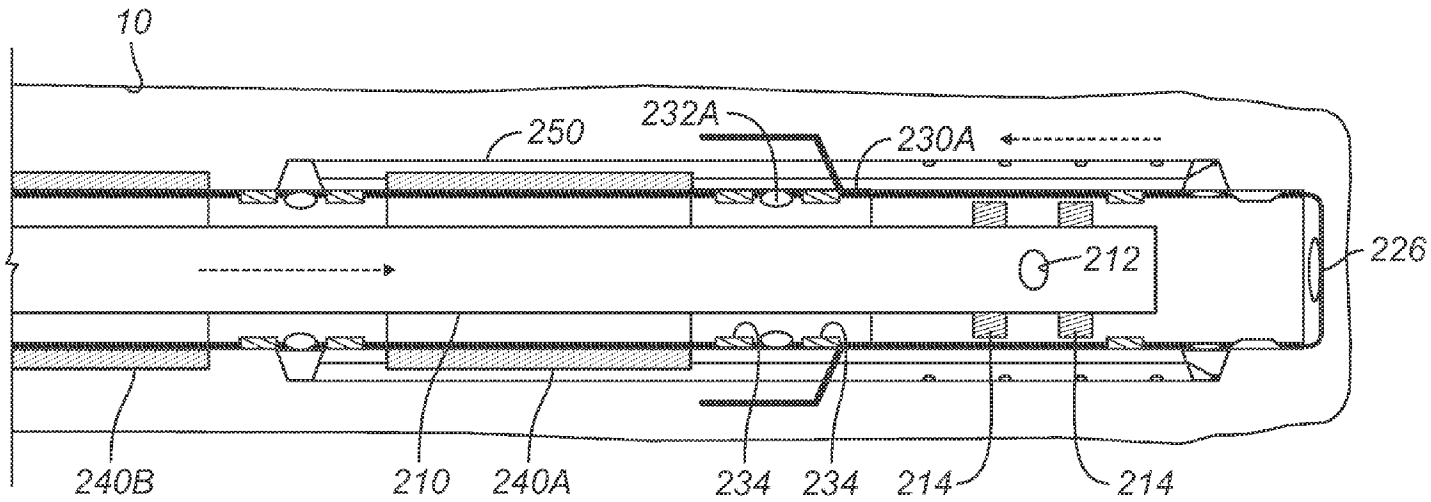

As shown in FIGS. 3A-3B, operators then set and test the packer 14. To set the packer 14, operators pump fluid downhole to hydraulically or hydrostatically set the packer 14 using procedures well known in the art, although other packer setting techniques can be used. To test the packer 14, the seals 204 on the service tool 202 are raised into the packer's bore after releasing from the packer 14. Operators then test the packer 14 by pressuring up the casing 12. Fluid passing through any pressure leak at the packer 14 will go into formation around the screen sections 240A-B. In addition, any leaking fluid will pass into the inner workstring's outlet ports 212 and up to the surface through the inner workstring 210. Regardless, the system 200 allows operators to maintain hydrostatic pressure on the formation during these various stages of operation.

Figure 4A:
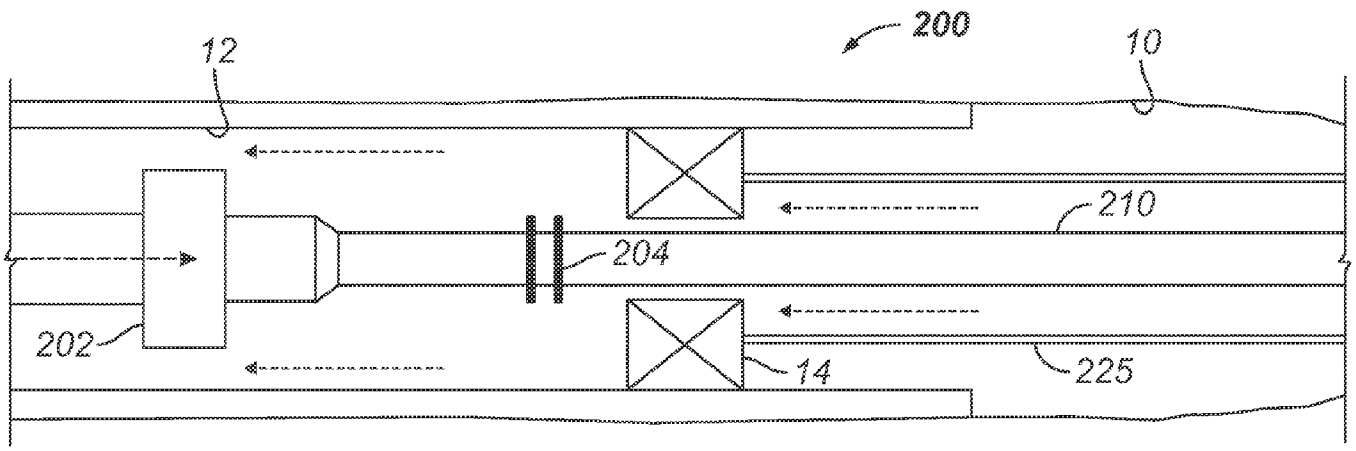
FIGS. 4A-4B show the system during gravel pack operations.
Figure 4B:
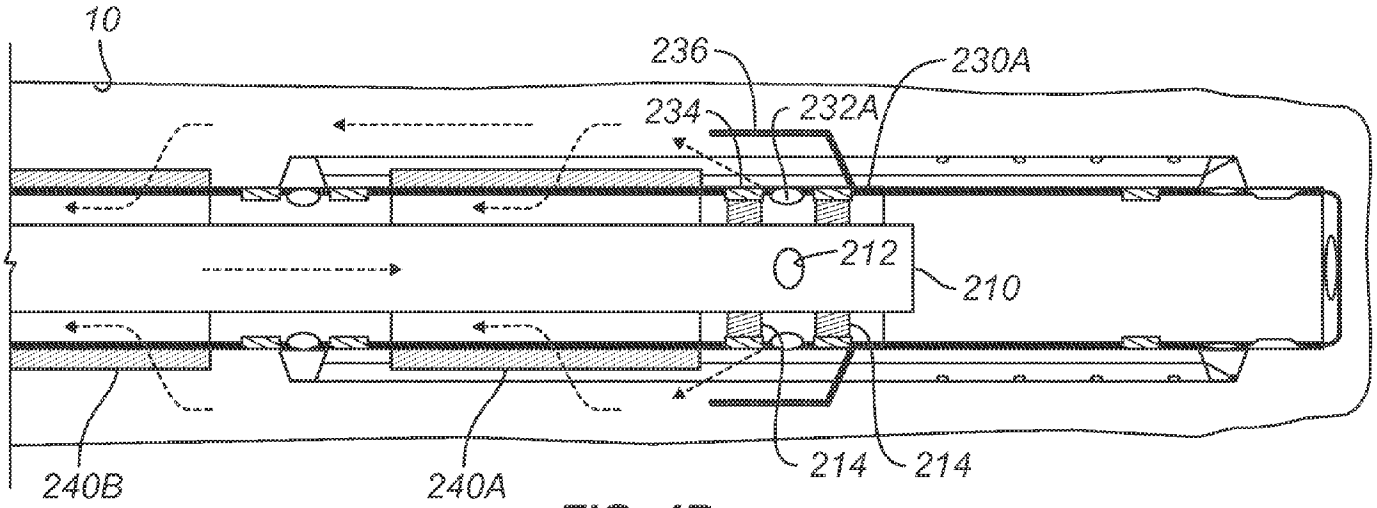

Once the packer 14 is set and tested, operators begin the gravel pack operation. As shown in FIGS. 4A-4B, operators raise the inner workstring 210 to locate in a first gravel pack position. As shown in FIG. 4B, the string's seals 214 engage the seats 234 around the lower ports 232A below the lower screen section 240A. When this is done, the tool ports 212 communicate with the housing's ports 232A.

When manipulating the inner workstring 210, operators are preferably given an indication at surface that the outlet ports 212 are located at an intended position, whether it is a blank position, a slurry circulating position, or an evacuating position. One way to accomplish this is by measuring tension or compression at the surface to determine the position of the inner workstring 210 relative to the ported housings 230A-B and seats 234. This and other procedures known in the art can be used.

With the ports 212/232A isolated by the engaged seals 214 and seats 234, operators pump the slurry of carrying fluid and gravel down the inner workstring 210 in a first direction to the string's ports 212. The slurry passes out of the pipe's ports 212 and through the housing's ports 232A to the open hole annulus. The carrying fluid in the slurry then leaks off through the formation and/or through the screen sections 240A-B along the length of the system 200. However, the screen sections 240A-B prevent the gravel in the slurry from flowing into the system 200. Therefore, the fluid passes alone through the screen sections 240A-B and returns through the casing annulus above the packer 14.

As described herein, the gravel can pack the annulus in an alpha-beta wave, although other variations can be used. As the fluid leaks off, for example, the gravel drops out of the slurry and first packs along the low side of the annulus in the borehole 10. The gravel collects in stages that progress from the toe (near housing 230A) to the heel in an alpha wave. Gravitational forces dominate the formation of the alpha wave, and the gravel settles along the low side at an equilibrium height along the screen sections 240A-B.

After the alpha wave, the borehole 10 fills in a beta wave along the system 200. The gravel begins to collect in the beta wave along the upper side of the screen sections 240A-B starting from the heel (near the packer 14) and progressing to the toe of the assembly 200. Again, the fluid carrying the gravel can leak through the screen sections 240A-B and up the annulus between the inner workstring 210 and the liner 225.

Figure 5A:
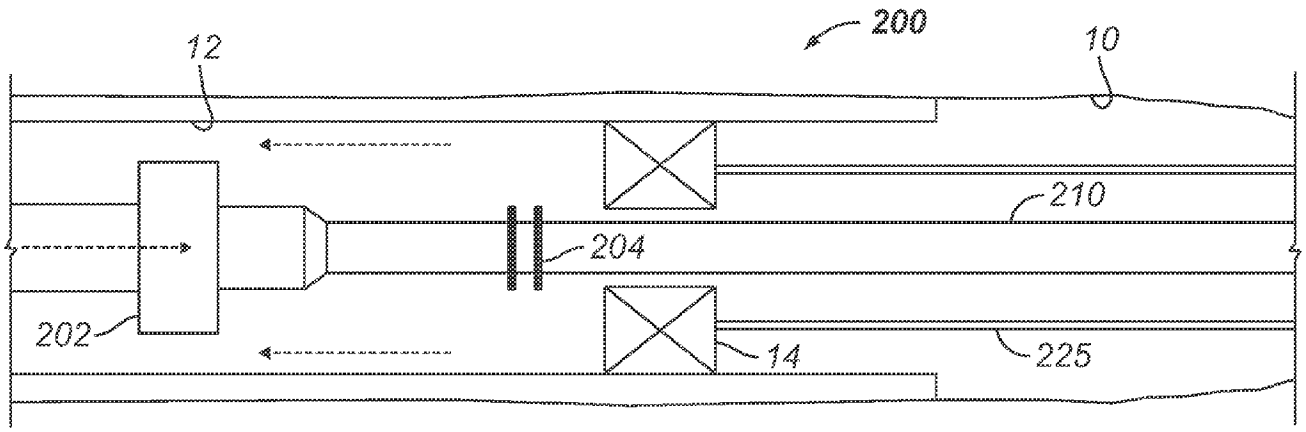
FIGS. 5A-5B show the system during filling of the annulus around the shoe track to dump excess slurry.
Figure 5B:
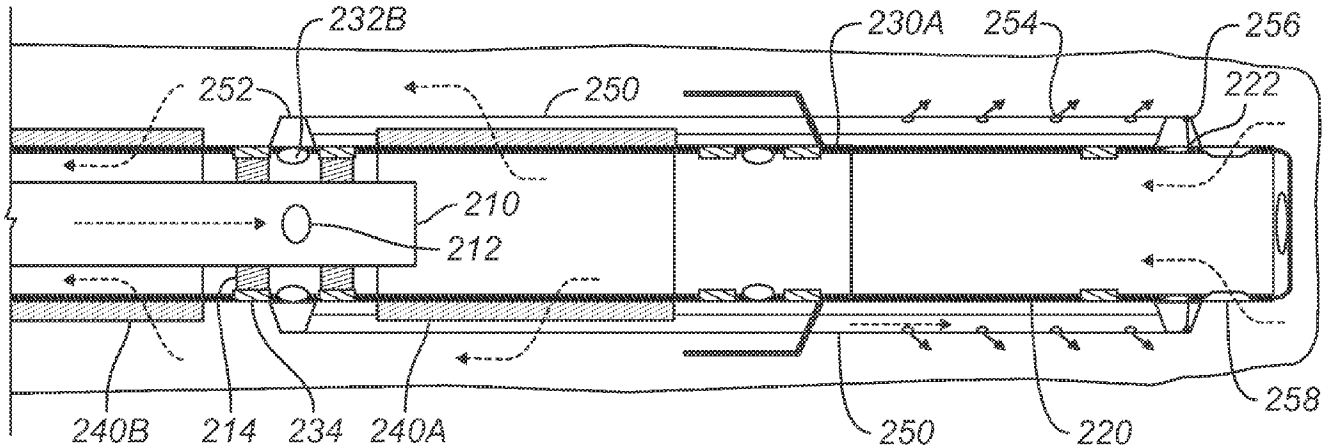

Eventually, the operators reach a desired state while pumping slurry at the ports 232A in this ported housing 230A. This desired state can be determined by a particular rise in the pressure levels and may be termed as "sand out" in some contexts. At this stage, operators raise the inner workstring 210 again as shown in FIGS. 5A-5B. The seals 214 now seat on seats 234 around the ports 232B on the next ported housing 230B between the screen sections 240A-B. Operators pump slurry down the inner workstring 210 again in the first direction to the outlet 212, and the slurry flows from the pipe's ports 212 and through the housing's ports 232B.

In general, the slurry can flow out of the ports 232B and into the surrounding annulus if desired. This is possible if one or more of the ports 232B communicate directly with the annulus and do not communicate with one of the alternate path devices or shunt 250. All the same, the slurry can flow out of the ports 232B and into the alternate path devices or shunts 250 for placement elsewhere in the surrounding annulus. Although shunts 250 are depicted in a certain way, any desirable arrangement and number of transport and packing devices for an alternate path can be used to feed and deliver the slurry.

Depending on the implementation, this second stage of pumping slurry may be used to further gravel pack the borehole. Yet, as shown in the current implementation, pumping the slurry through the shunts 250 enables operators to evacuate excess slurry from the inner workstring 210 to the borehole without reversing flow in the string 210 from the first flow direction (i.e., toward the string's port 212). This is in contrast to a reverse direction of flowing fluid down the annulus between the string 210 and the housings 230A-B/screens 240A-B to evacuate excess slurry from the string 210.

As shown in FIG. 5B, the slurry travels from the port 212, through flow ports 232B, and through the shunts 250. From the shunts 250, the slurry then passes out the side ports or nozzles 254 in the shunts 250 and fills the annulus around shoe track 220. This provides the gravel packing operation with an alternate path different from the system's primary path of toe-to-heel. In this way, the shunts 250 attached to the ported housing 230B above the lower screen section 240A can be used to dispose of excess gravel from the workstring 210 around the shoe track 220. The shunts 250 carry the slurry down the lower screen section 240A so a wash pipe is not needed at the end of the section 240A. However, a bypass 258 defined in a downhole location of the system 200 (or elsewhere) allows for returns of fluid during this process. This bypass 258 can be a check valve, a screen portion, sleeve, or other suitable device that allows flow of returns and not gravel from the borehole to enter the system 200. In fact, the bypass 258 as a screen portion can have any desirable length along the shoe track 220 depending on the implementation.

At some point, operation may reach a "sand out" condition or a pressure increase while pumping slurry at ports 232B. At this point, a valve, rupture disc, or other closure device 256 in the shunts 250 can open so the gravel in the slurry can then fill inside the shoe track 220 after evacuating the excess around the shoe track 220. In this way, operators can evacuate excess gravel inside the shoe track 220. As this occurs, fluid returns can pass out the lower screen section 240A, through the packed gravel in the annulus, and back through upper screen section 240B to travel uphole. In other arrangements, the lower ported housing 230A can have a bypass, another shunt, or the like (not shown), which can be used to deliver fluid returns past the seals 214 and seats 234 and uphole.

Figure 6A:
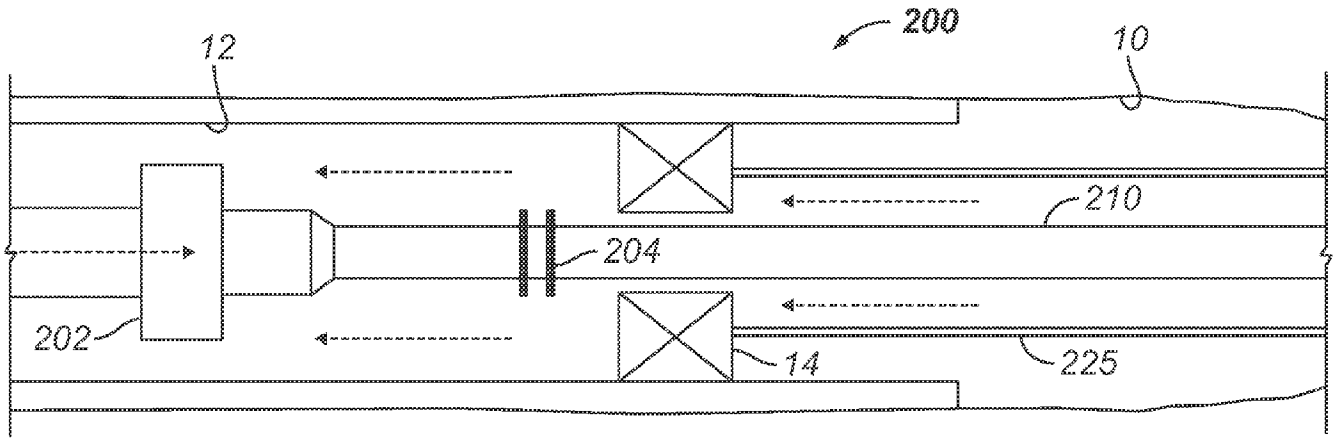
FIGS. 6A-6B show yet another multi-zone screened system according to the present disclosure having alternating shunts for gravel pack operations.
Figure 6B:
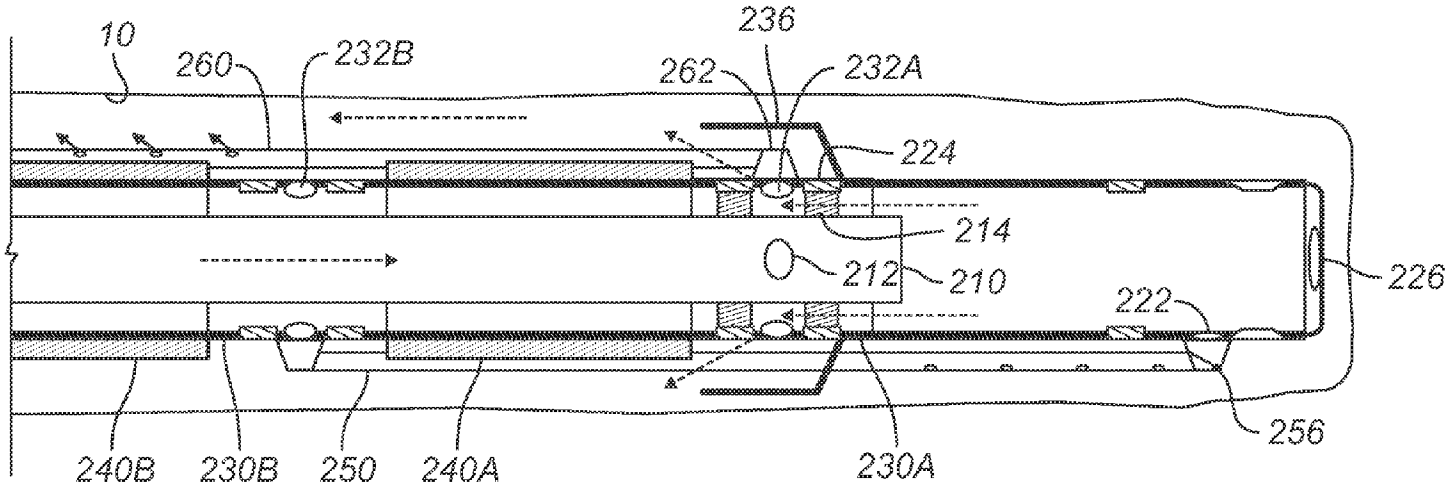

The previous system 200 filled the open hole annulus with an alpha-beta type wave and then filled the annulus around the toe with an alternate path. As shown in FIGS. 6A-6B, the system 200 can use an additional alternative path device or shunt 260 to fill the open hole annulus while circulating in the gravel pack operation. In this arrangement, the operation of the system 200 is similar to that discussed previously. Again, the system 200 has one or more ported housings 230A-B for the slurry to exit and has one or more screen sections 240A-B.

When operators raise the inner workstring 210 to locate in the gravel pack position shown in FIG. 6B, operators pump at least some of the slurry into the open hole annulus using the additional shunts 260 in an alternative path gravel pack. The shunts 260 may be used exclusively. Alternatively, the slurry can be pumped out through one or more of the housing's ports 232A at the same time. By using an arrangement of shunts 250/260 and open flow ports 232, the system 200 can gravel pack zones from toe-to-heel, from heel-to-toe, and combinations thereof.

As can be seen in FIGS. 2A through 6B, the disclosed system 200 can be used in a number of versatile ways to gravel pack the annulus of a borehole. For example, the string's outlet ports 212 can locate in one or more different ported housings 230A-B to gravel pack around the screen sections 240A-B in an alpha-beta wave or alternative path. Additionally, the inner workstring 210 can be moved to multiple housings 230A-B to pack a single zone from multiple points or to gravel pack the same zone from a first direction and then from a different direction (e.g., first from bottom to top and then from top to bottom using shunts 250/260).

Moreover, the inner workstring 210 can be used to pump treatments of different types into a surrounding zone. For example, the system 200 of FIGS. 2A through 6B can be used to perform frac packing from one point and then gravel packing (via shunts 250 and/or 260) from another point along the screen sections 240A-B. In frac packing, operators perform a frac treatment by delivering large volumes of graded sand, proppant, or the like into the annulus and into the formation at pressures exceeding the frac gradient of the formation. The graded sand or proppant enters fractures in the borehole 10 to keep the fractures open. After the frac treatment, operators can then perform a gravel pack operation to fill the annulus with gravel. Alternatively, the gravel pack and frac treatment can be performed at the same time.

In a frac packing arrangement, the disclosed system 200 can deliver the frac treatment and gravel slurry through the multiple ported housing 230A-B into the annulus around the screen sections 240A-B. Dispersing the frac treatment and slurry through the multiple ports 232A-B can provide more even distribution across a greater area. For the fracturing part of the process, the frac treatment can exit from the lower ported housing 230A, and fluid returns can pass through the screen section 240B adjacent to the casing annulus until the fracture is complete. Afterwards, the inner workstring 210 can be moved to the upper ported housing 230B so that gravel slurry can flow through shunts 250 and/or 260 to gravel pack the annulus. A reverse operation could be done in which frac treatment can exit upper housing 230B so that gravel packing can be done primarily at the lower housing 230A using toe-to-heel gravel packing.

When used for frac/gravel packing, the system 200 may reduce the chances of sticking. Because the system 200 can have a smaller volumetric area around the exit points, there may be less of a chance for proppant sticking around the gravel pack ports 212. As slurry exits near the end of the inner workstring 210, only a short length of pipe has to travel upward through remaining slurry or dehydrated sand that may be left. If sticking does occur around the gravel pack ports 212, a shear type disconnect (not shown) can be incorporated into the inner workstring 210 so that the lower part of the inner workstring 210 can disconnect from an upper part of the inner workstring 210. This allows for the eventual removal of the inner workstring 210.

Figure 7:
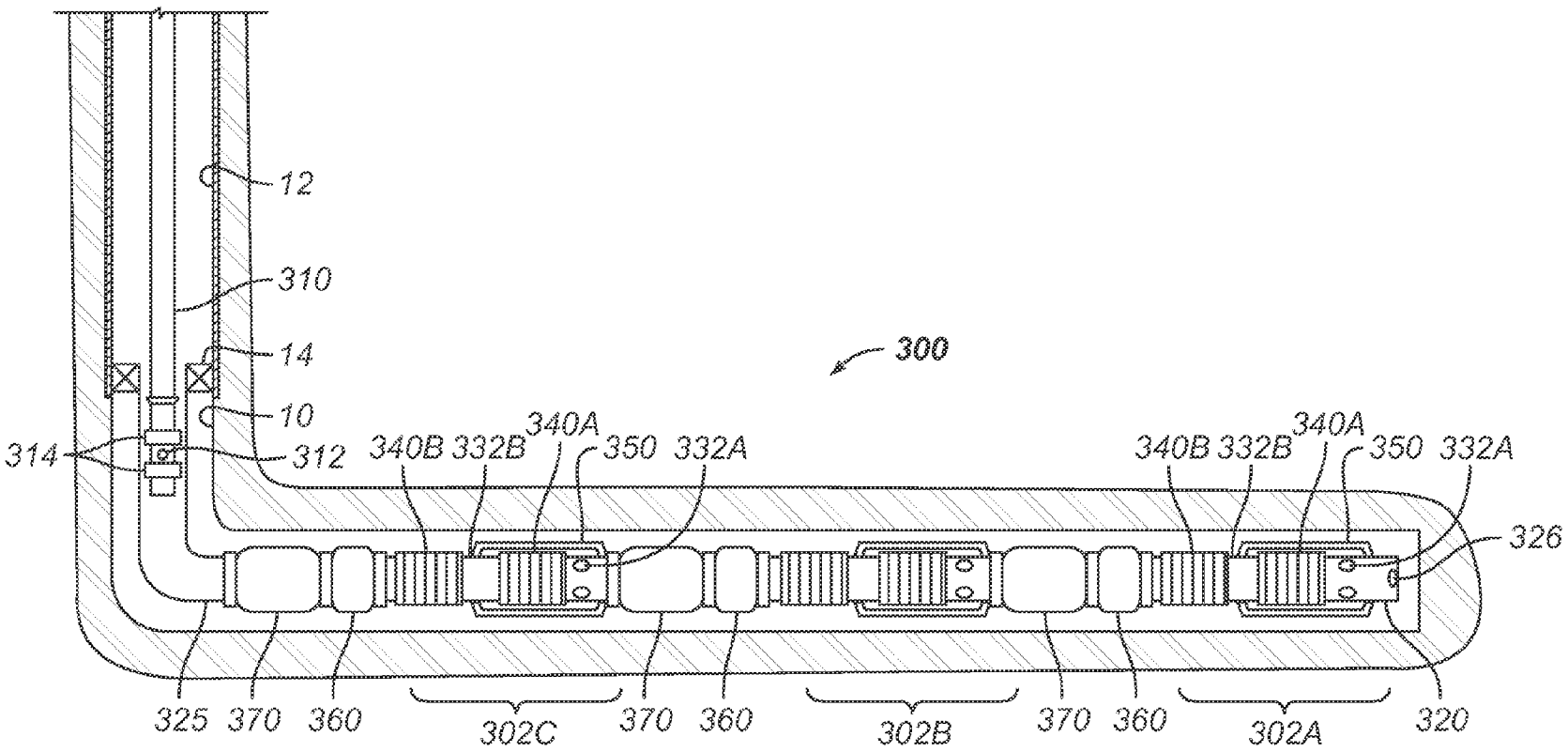
FIG. 7 shows a multi-zone screened system having screen sections separated by packers.

Expanding on the versatility of the disclosed system, FIG. 7 shows a system 300 segmenting several compartmentalized reservoir zones. Again, the system 300 can be used for formation treatments, such as frac operations, frac pack operation, gravel pack operations, or other operations. The system 300 includes a production string or liner 325 (e.g., tubular structure or body) and includes an inner workstring 310. The liner 325 extends into a borehole 10 from a liner packer 14 supported in casing 12. Again, this borehole 10 can be a horizontal or deviated open hole.

The liner 325 has multiple gravel pack sections 302A-C separated by packers 360/370. The packers 360/370 and gravel pack sections 302A-C are deployed into the well in a single trip. One packer 360/370 or a combination of packers 360/370 can be used to isolate the gravel pack sections 302A-C from one another. Any suitable packers can be used and can include hydraulic or hydrostatic packers 360 and swellable packers 370, for example. Each of these packers 360/370 can be used in combination with one another as shown, or the packers 360 or 370 can be used alone.

The hydraulic packers 360 provide more immediate zone isolation when set in the borehole 10 to stop the progression of the gravel pack operations in the isolated zones. For their part, the swellable packers 370 can be used for long-term zone isolation. The hydraulic packers 360 can be set hydraulically with the inner workstring 310 and its packoff arrangement 314, or the packers 360 can be set by shifting sleeves (not shown) in the packers 360 with a shifting tool (not shown) on the inner workstring 310.

Each gravel pack section 302A-C can be similar to the assemblies 200 as discussed above in FIGS. 2A through 6B. As such, each gravel pack section 302A-C has two screens 340A-B, alternate path devices or shunts 350, and ports 332A-B and can have the ported housings and other components discussed previously. After the inner workstring 310 deploys in the first gravel pack section 302A and performs wash down, the string's outlet ports 312 with its seals 314 isolates to the lower flow ports 332A to gravel pack and/or frac the first gravel pack section 302A. Then, the inner workstring 310 can be moved so that the outlet ports 312 isolates to upper flow ports 332B connected to the shunts 350 to fill the annulus around the lower end of the first gravel pack section 302A. A similar process can then be repeated up the hole for each gravel pack section 302A-C separated by the packers 360/370. Using the procedures disclosed above, excess slurry can be evacuated from the inner workstring 310 to the annulus before the workstring 310 is moved between sections 302A-C.

Figure 8:
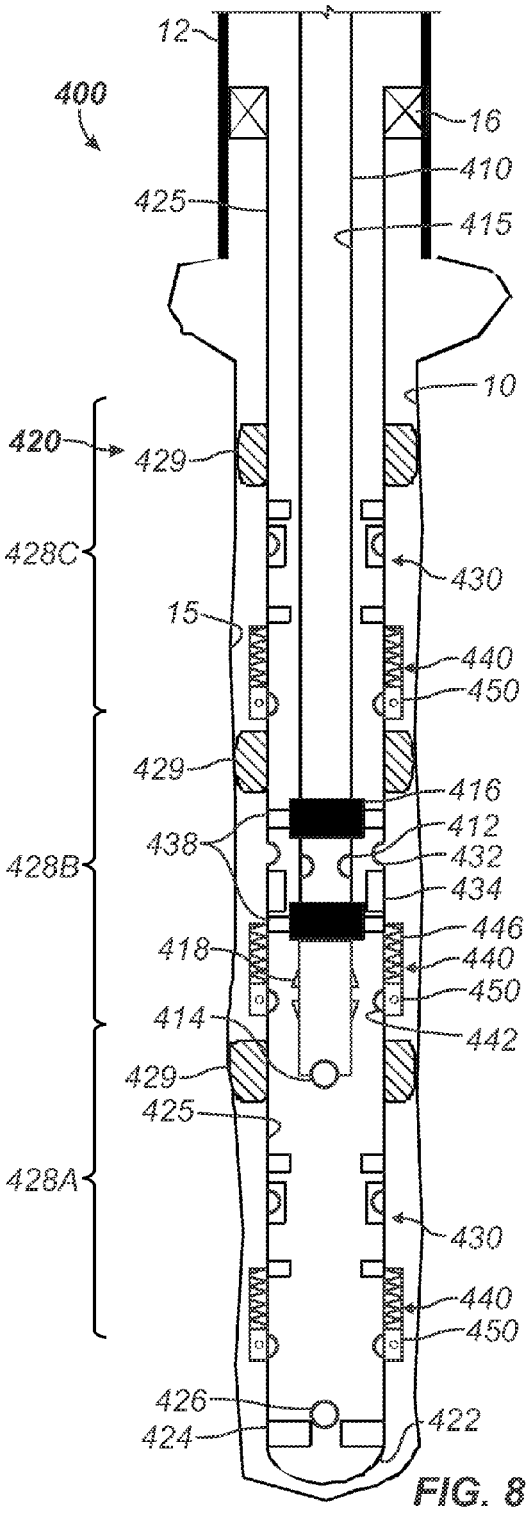
FIG. 8 illustrates a multi-zone screened system according to the present disclosure disposed in an uncased borehole and using a workstring in conjunction with valves and flow devices.
Figure 9:
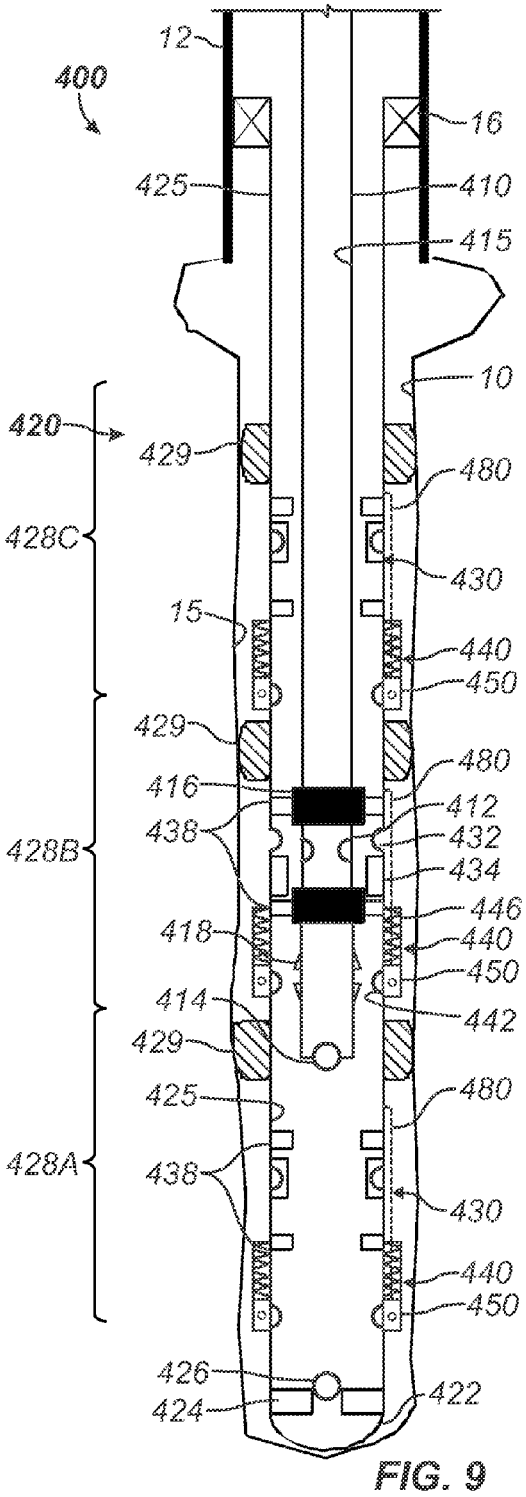
FIG. 9 illustrates the multi-zone screened system of FIG. 8 having bypass tubes.

Turning now to FIGS. 8-9, another multi-zone screened system 400 includes an inner workstring 410 and a screened assembly 420. Again, the system 400 can be used for formation treatments, such as frac operations, frac pack operation, gravel pack operations, or other operations. The screened assembly 420 has a production string or liner 425 (e.g., tubular structure or body) that extends into a borehole 10 from a liner packer 14 supported in casing 12. At its end, the liner 425 can have a float shoe 422 or the like, and sections 428A-C disposed on the liner 425 can each have an isolation element 429, a flow valve 430, a screen 440, and a closure 450.

As shown in FIG. 8, the workstring 410 positions in the assembly 420 to open the various valves 430 and treat portions of the formation. As shown, the workstring 410 has external seals 416 disposed near outlet ports 412. A dropped ball 414 can seat in a distal seat of the workstring 410 to divert fluid flow down the workstring 410, out the outlet ports 412, and to the open ports 432 in the valve 430 to treat the surrounding formation.

The flow devices 440 disposed on the assembly 420 include wellscreens 446 and the closures 450 (i.e., one-way or check valves, sliding sleeves, etc.). As one-way or check valves, the closures 450 can be configured in different ways and can include ball, poppet, or disk type check valves that are concentrically or eccentrically mounted on the outer radius of the screen's basepipe. The closures 450 can be part of a housing that directs flow into a basepipe and can attach to the wellscreens to ensure fluid flow is filtered of solids. Preferably, multiple closures 450 can be installed on each joint to reduce and even out pressure drops across the screen joints to promote complete development of the beta wave during gravel packing. Alternatively, the closures 450 can be mounted into the basepipe and can allow flow into a housing mounted on the radial exterior of the basepipe and attached to the wellscreen 446.

The operation for the system 400 of FIG. 8 involves running the screened assembly 420 downhole and setting the packers 429 to create the multiple isolated sections 428A-C down the borehole annulus 15. Once the packers 429 are set, operators apply a frac treatment successively to each of the isolated sections 428A-C by selectively opening the selective valves 430 with a shifting tool 418 on the workstring 410.

In general, the shifting tool 418 can be a "B" shifting tool for shifting the inner sleeve 434 in the valve 430 relative to the valve's ports 432. Thus, opening a given valve 430 involves engaging the shifting tool 418 in an appropriate profile of the valve's inner sleeve 434 and moving the inner sleeve 434 with the workstring 410 to an opened condition so that the assembly's through-bore 425 communicates with the borehole annulus 15 via the now opened ports 432.

Once a given valve 430 is opened, the seals 416 on the workstring 410 can engage and seal against inner seats 438, surfaces, seals, or the like in the valve 430 or elsewhere in the assembly 420 on both the uphole and downhole sides of the opened ports 432. The seals 416 can use elastomeric or other types of seals disposed on the inner workstring 410, and the seats 438 can be polished seats or surfaces inside the valve 30 or other parts of the screened assembly 420 to engage the seals 416. Although shown with this configuration, the reverse arrangement can be used with seals on the inside of the valve 430 or the screened assembly 420 and with seats on the workstring 410.

Once the workstring 410 is seated, treatment fluid is flowed down the through-bore 415 of the workstring 410 to the sealed and opened ports 432 in the valve 430. The treatment fluid flows through the outlet ports 412 in the workstring 410 and through the opened ports 432 to the surrounding borehole annulus 15, which allows the treatment fluid to interact with the adjacent zone of the formation.

Once treatment is completed for the given zone 428A-C, operators manipulate the workstring 410 to engage the shifting tool 418 in the valve 430 to close the ports 432. For example, the shifting tool 418 can engage another suitable profile on the inner sleeve 434 of the valve 430 to move the sleeve 434 and close the ports 432. At this point, the workstring 410 can be moved in the assembly 420 to open another one of the valves 430 to perform treatment. Operators repeat this process up the assembly 420 to treat all of the sections 428A-C. Once the treatment is complete, the system 400 may not need a clean-out trip.

The multi-zone system 400 of FIG. 8 can have higher rates compared to a conventional single trip multi-zone system and can improve reservoir performance. The system 400 can have any suitable length and spacing, offers the option to step down one casing size, does not require perforating, and does not require a clean-out trip. Consideration should be given to potential sticking the workstring 410 during operation and to annulus packing that can occur for a particular implementation.

In another embodiment, the multi-zone screened system 400 of FIG. 9 also has a workstring 410 and screened assembly 420, as with the previous embodiment of FIG. 8. In addition to all of the same components, this system 400 has slurry dehydration or bypass tubes 480 disposed along the various sections 428A-C.

During a treatment operation similar to that discussed above, the tubes 480 help dehydrate slurry intended to frac or gravel pack the borehole annulus 15 of the sections 428 during a frac pack or gravel pack type of operation. In addition, the tubes 480 can act as a bypass for fluid returns during the operation. As treatment fluid flows from the workstring 410 seated in a valve 430, through the opened ports 432, and into the borehole annulus 15, the wellscreen 446 screens fluid returns from the annulus 15, and the fluid returns can flow into the assembly 420 downhole of the engagement of the workstring 410 in the assembly 420. The tubes 480 can, therefore, allow these fluid returns to flow from the downhole section of the assembly 420 to the micro-annulus between the workstring 410 and the inside of the assembly 420 uphole of the sealed engagement of the workstring 410 with the ports 432. From this point, the fluid returns can then flow to the surface.

The multi-zone system 400 of FIG. 9 can have higher rates compared to a conventional single trip multi-zone system 400 and can improve reservoir performance. Furthermore, the system 400 can have any length and spacing, offers the option to step down one casing size, does not require perforating, does not require a clean-out trip, and can give good annulus packing. Consideration should be given to potential sticking of the workstring 410 for a particular implementation.

Figure 10A:
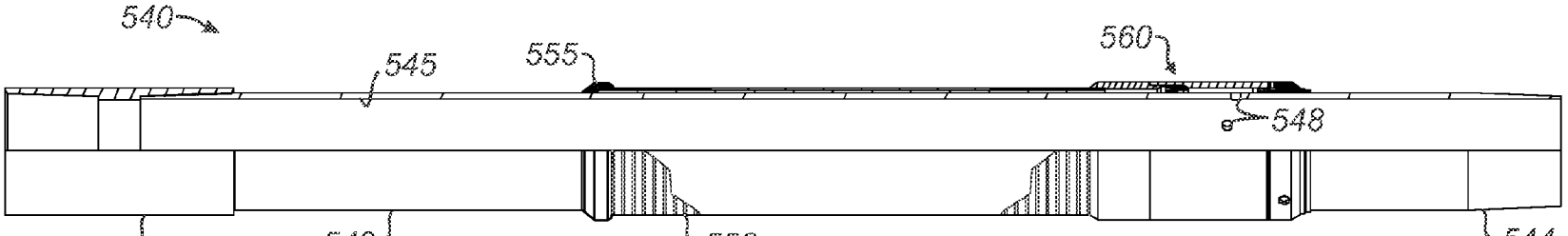
FIG. 10A illustrates a partial cross-sectional view of a flow device for the disclosed multi-zone screened assemblies.
Figure 10B:
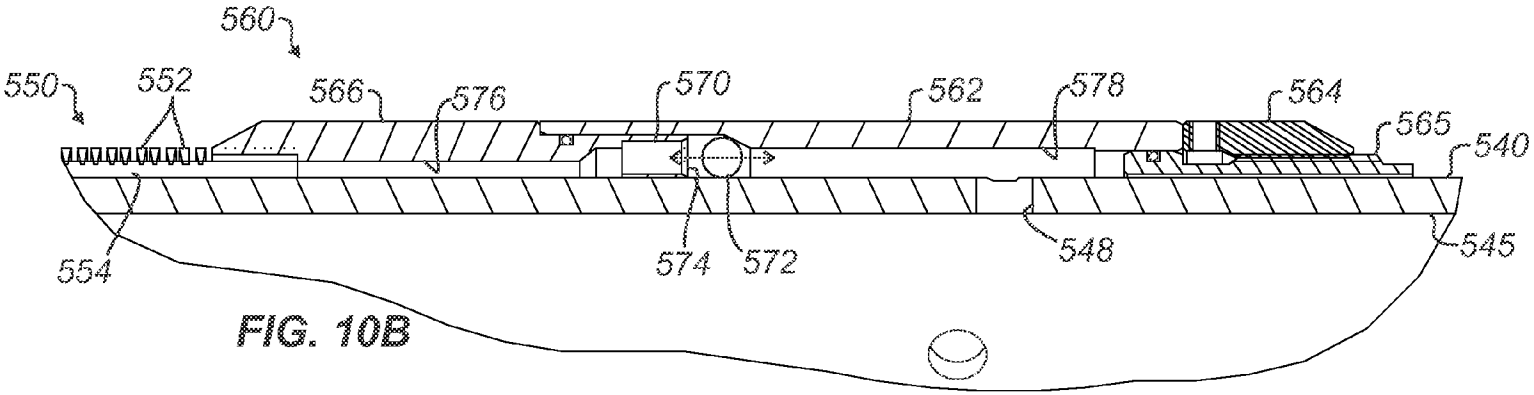
FIG. 10B illustrates a detailed view of a check valve device for the flow device of FIG. 10A.
Figure 10C:
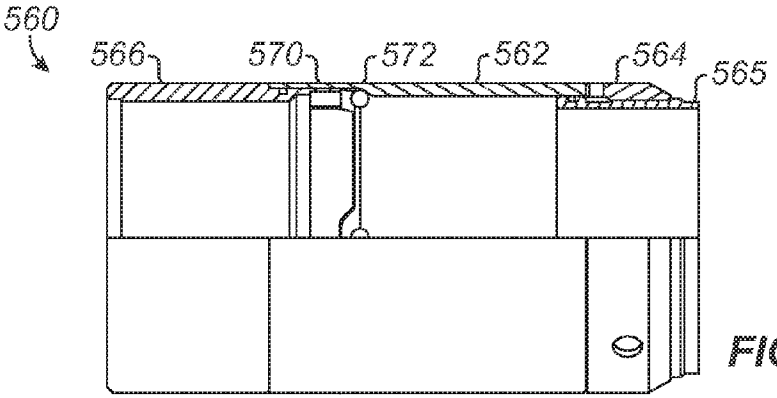
FIG. 10C illustrates an isolated, partial cross-sectional view of the flow device of FIG. 10A.

As noted above, the multi-zone system 400 can use flow devices 440 disposed on the assembly 420, and the flow device 440 includes the wellscreen 446 and the closure 450 (i.e., one-way or check valves). Turning now to FIGS. 10A-10B, one embodiment of a flow device 540 that can be used for the disclosed systems 400 is shown in a partial cross-sectional view and a detailed view, respectively. The flow device 540 is a screen joint having a screen jacket 550 (i.e., wellscreen) and an inflow control device 560 (i.e., one-way or check valve) disposed on a basepipe 542. (FIG. 10C shows the inflow control device 560 in an isolated view without the basepipe 542 and the screen jacket 160.)

The flow device 540 is deployed on a completion string (422: FIGS. 8-9) with the screen jacket 550 typically mounted upstream of the inflow control device 560, although this may not be strictly necessary. The basepipe 542 defines a through-bore 545 and has a coupling crossover 546 at one end for connecting to another joint or the like. The other end 544 can connect to a crossover (not shown) of another joint on the completion string (422). Inside the through-bore 545, the basepipe 542 defines pipe ports 548 where the inflow control device 560 is disposed.

As noted above, the inflow control device 560 can be similar to a FloReg deploy-assist (DA) device available from Weatherford International. As best shown in FIG. 10B, the inflow control device 560 has an outer sleeve 562 disposed about the basepipe 152 at the location of the pipe ports 548. A first end-ring 564 seals to the basepipe 542 with a seal element 565, and a second end-ring 566 attaches to the end of the screen jacket 550. Overall, the sleeve 562 defines an annular space around the basepipe 542 communicating the pipe ports 548 with the screen jacket 550. The second end-ring 566 has flow ports 570 that separate the sleeve's annular space into a first inner space 576 communicating with the screen 550 and second inner space 578 communicating with the pipe ports 548.

For its part, the screen jacket 550 is disposed around the outside of the basepipe 542. As shown, the screen jacket 550 can be a wire wrapped screen having rods or ribs 554 arranged longitudinally along the base pipe 542 with windings of wire 552 wrapped thereabout to form various slots. Fluid can pass from the surrounding borehole annulus to the annular gap between the screen jacket 550 and the basepipe 542. Although shown as a wire-wrapped screen, the screen jacket 550 can use any other form of screen assembly, including metal mesh screens, pre-packed screens, protective shell screens, expandable sand screens, or screens of other construction.

Internally, the inflow control device 560 has a number (e.g., ten) of flow ports 570. Rather than providing a predetermined pressure drop along the screen jacket 550 by using multiple open or closed nozzles (not shown), the inflow control device 560 as shown in FIGS. 10A-100 may lack the typically used restrictive nozzles and closing pins for the internal flow ports 570. Instead, the flow ports 570 may be relatively unrestricted flow passages and may lack the typical nozzles, although a given implementation may use such nozzles if a pressure drop is desired from the screen jacket 550 to the basepipe 542.

Internally, however, the inflow control device 560 does include port isolation balls 572, which allow the device 560 to operate as a one-way or check valve. Depending on the direction of flow or pressure differential between the inner spaces 576 and 578, the port isolation balls 572 can move to an open condition (to the right in FIG. 10B) permitting fluid communication from the screen's inner space 576 to the pipe's inner space 578 or to a closed condition (to the left in FIG. 10B against a seat end 574 of the flow port 570) preventing fluid communication from the pipe's inner space 578 to the screen's inner space 576.

In general, the inflow control device 560 can facilitate fluid circulation during deployment and well cleanup and can be used in interventionless deployment and setting of openhole packers. In deployment, for example, the isolation balls 572 maximize fluid circulation through the completion shoe (420: FIGS. 8-9) of the frac system (20) to aid efficient deployment of the completion string (22) and system (20).

When the housing components (562, 564, 565, & 566) are disposed on the basepipe 540, the isolation balls 572 are retained in-place. During initial installation and production, the isolation balls 572 can prevent formation surging, thereby reducing damage to the formation. In some arrangements, the isolation balls 572 within the device 560 can be configured to erode over a period of time, allowing access to the interval for workover activity such as stimulation.

Should a pressure drop be desired from the screen jacket 550 to the basepipe 542, the flow ports 570 can include nozzles (not shown) that restrict flow of screened fluid (i.e., inflow) from the screen jacket 550 to the pipe's inner space 578. For example, the inflow control device 560 can have ten nozzles, although they all may not be open. Operators can set a number of these nozzles open at the surface to configure the device 560 for use downhole in a given implementation. Depending on the number of open nozzles, the device 560 can thereby produce a configurable pressure drop along the string of such flow devices 540.

Figure 11A:
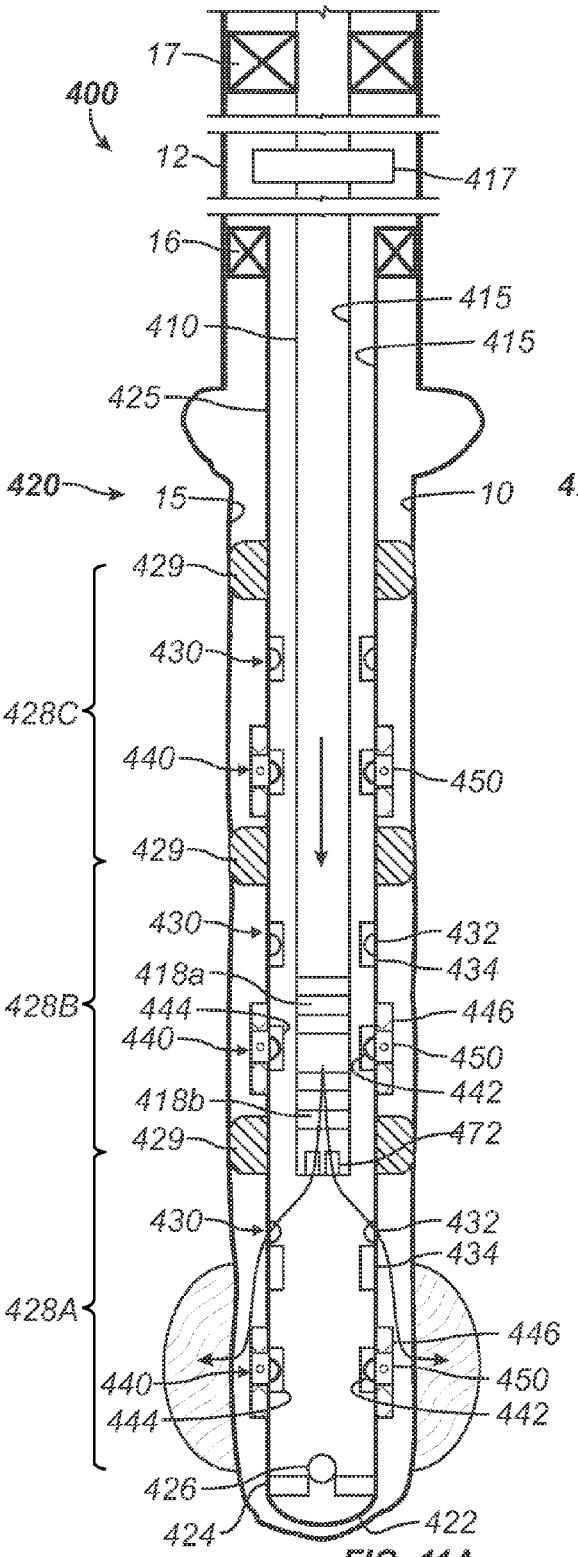
FIGS. 11A-11B illustrate another multi-zone screened system according to the present disclosure disposed in a uncased borehole and using a workstring in conjunction with valves and flow devices.
Figure 11B:
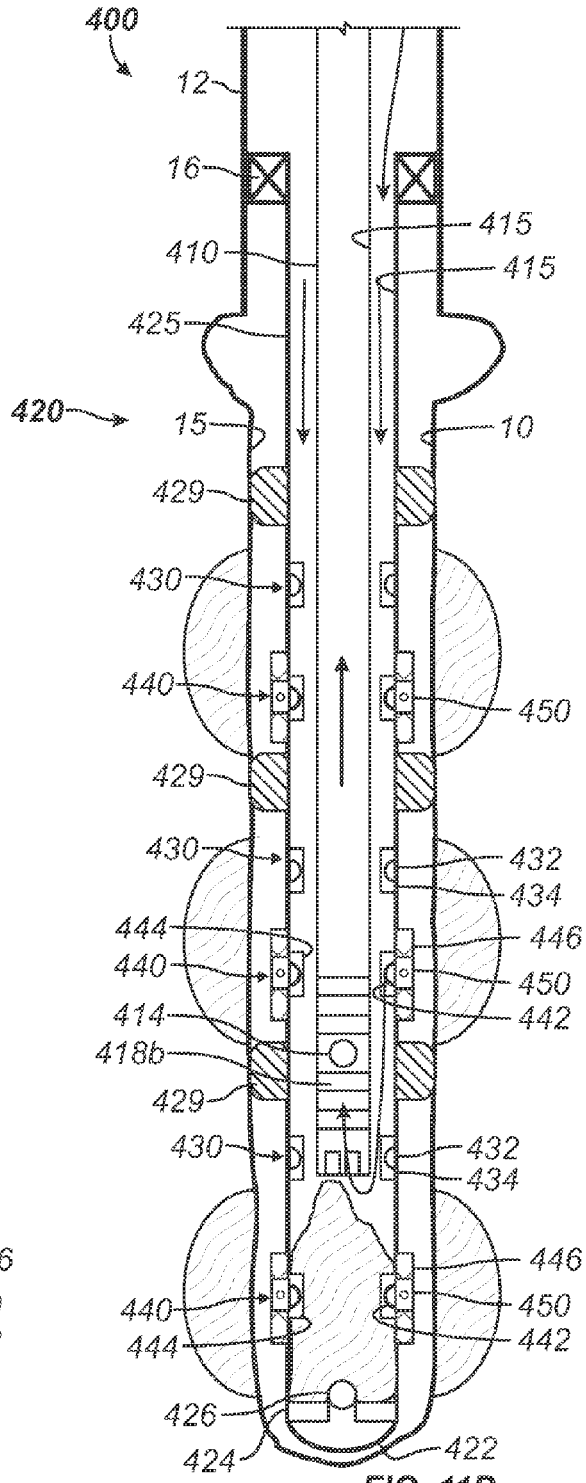

FIGS. 11A-11B illustrate another multi-zone screened system 400 according to the present disclosure used for an open hole completion. Again, the system 400 can be used for formation treatments, such as frac operations, frac pack operation, gravel pack operations, or other operations. As with some previous arrangements, the system 400 has a workstring 410 that disposes in a screened assembly 420 to open the various valves 430 and treat portions of the formation, but the workstring 410 in this arrangement does not seal inside the assembly 420 when delivering the treatment at various points in the formation.

As shown, a service packer 17 can be used between the workstring 410 and the casing 12 to isolate the internal through-bore 425 of the assembly 420. As also shown, the workstring 410 has a service tool 417 disposed above the liner packer 16. The service tool 417 can be used for hydraulically setting the packer 16. Regardless of the configuration used, the uphole components of the system 400 can be used for circulating, squeeze, and reverse out operations as is known in the art.

The workstring 410 has one or more outlet ports 412 and has hydraulically actuated shifting tools 418*a-b*. Both of the shifting tools 418*a-b* can be actuated with applied pressure against a ball when seated in the workstring 410. One shifting tool 418*b* can open the valves 430 when the workstring 410 is run downhole in the assembly 420, while the other shifting tool 418*a* can close the valves 430 when the workstring 410 is run uphole in the assembly 420. The same can be true for opening and closing the flow devices 440 with the shifting tools 418*a-b* as discussed below. Thus, one shifting tool 418*b* is run facing down, while the other tool 418*a* is run facing up. Other arrangements can be used, and other types of shifting tools can be used as well.

As an example, the shifting tools 418*a-b* can each be a hydraulically actuated version of an industry standard B shifting tool. When the shifting ball (74) is dropped in the workstring 410, the application of hydraulic pressure down the workstring 410 actuates the shifting tools 418*a-b* so that they expose spring-loaded keys for shifting the valves 430 and flow devices 440 open or closed. The shifting tools 418*a-b* may be actuated together with the same ball 414 or actuated separately with different sized balls 414 depending on the configuration.

As before, the assembly 420 has a production string 422 supported from a packer 16 in the casing 12. Along its length, the string 422 has isolation devices 429, valves 430, and flow devices 440. The isolation devices 429, which can be packers, seal the borehole annulus 15 around the assembly 420 and separate the annulus 15 into various zones or sections 428A-C. Each section 428A-C has at least one of the valves 430 and at least one of the flow devices 440, both of which can selectively communicate the string's through-bore 425 with the borehole annulus 15 as detailed below. At its downhole end, the assembly 420 has a bottom seat 422 for engaging a setting ball 424 to close off the shoe 420 during frac, gravel pack, or frac pack operations.

As shown, the selective valve 430 is disposed uphole of the flow device 440 in each of the various sections 428A-C. As an alternative, the selective valve 430 can be disposed downhole of the flow device 440 in each section 428A-C. Moreover, a given section 428A-C may have more than one valve 30 and/or flow device 440.

The selective valves 430 have one or more ports 432 that can be selectively opened and closed during operation. In this arrangement as with others discussed above, each of the selective valves 430 can be opened to communicate their ports 432 with the surrounding annulus 15 by using the shifting tool 418*a* on the workstring 410. As before, the valves 430 can be sliding sleeves having a movable closure element 434, such as an inner sleeve or insert, which isolates or exposes ports 432 in the sliding sleeve's housing.

Similar to the valves 430, the flow devices 440 also have one or more ports 442 that can be selectively opened and closed during operation. Each of the flow devices 440 also includes a closure and a screen 446. The closure in this arrangement includes a first closure element 444 that selectively opens and closes flow through the flow ports 442 and includes a second closure element 450 that at least prevents fluid flow from the through-bore 425 through the screen 446.

This system 400 is a single trip, multi-zone system as discussed in previous embodiments. Briefly, the assembly 420 is run downhole as part of the production string 422 or liner system deployed in the borehole, and the liner packer 16 is set hydraulically. Treatments are then performed for the various zones or sections 428A-B of the borehole annulus 15 by selectively opening the valves 430.

After treatment (e.g., gravel packing or fracing) is completed, excess gravel or proppant is cleaned out of the assembly 420, and the valves 430 are closed because they are used primarily for outlet ports for the treatment. To prepare the assembly 420 for production, the flow devices 40 are then opened in the assembly 420 with the workstring 410 in the same trip in the wellbore by opening the first closure element 444 (e.g., inner sleeve) to expose the flow ports 442. Once open, the flow devices 440 screen fluid from the borehole annulus 15 into the string's through-bore 425. At the same time, the flow device's second closure element 450 functions to prevent flow in the reverse direction. As discussed in more detail below, for example, the flow device's second closure element 450, which can use one-way or check valve, can prevent fluid loss into the formation while pulling out the workstring 410 from the assembly 420 and while performing production.

With a general understanding of how the assembly 420 is used, discussion now turns to how treatment operations are performed in more detail. Initially, all of the valves 430 and flow devices 440 are closed on the assembly 420 when run in the borehole. After setting the liner packer 16 and closing off the bottom seat 450 with the setting ball 454, operators set the packers 429 along the assembly 420 with the appropriate procedures to create the multiple isolated sections 428A-C down the borehole annulus 15. Once the packers 429 are set, operators can then commence with applying treatment successively to each of the isolated sections 428A-C by selectively opening and then closing the selective valves 430 with the shifting tools 418*a-b* on the workstring 410.

As shown in FIG. 11A, for example, the selective valve 430 for the lower section 428A is opened, but its accompanying flow device 440 remains closed. To open this lower valve 430, operators position the workstring 410 near the valve 430 and drop the shifter ball (414) to the shifting tools 418*a-b* on the workstring 410. Operators then pressure up the workstring 410, and the applied pressure in the workstring's bore 415 acts against the seated ball (414) and actuates the shifting tools 418*a-b*. Using the opening tool (e.g., 418*b*), operators open the valve 430 (e.g., by shifting the inner sleeve 434 in the valve 430 open). Once the valve 430 is open, operators then bleed off the applied pressure and reverse the flow so that the seated ball (414) in the workstring 410 can be reversed out through the workstring's bore 415 to the surface.

For example, the flow device 440 can be a sliding sleeve having a movable closure element 444, such as an inner sleeve or insert, which isolates or exposes the ports 442 in the sliding sleeve's housing. The flow device 440 can be opened to communicate its ports 442 with the surrounding annulus 15 through its screen 446 by using the shifting tool 418*a* on the workstring 410. In this way, the flow device 440 when closed does not communicate the string's through-bore 425 with the borehole annulus 15 through screens 446, but the flow device 440 when opened allows screened fluid from the annulus 15 to pass through the screen 446 on the device 440 and into the through-bore 425.

Now, operators position the workstring 410 uphole of the open valve 30 as shown in FIG. 11A. In manipulating the workstring 410 in the assembly 420, the workstring 410 is positioned unsealed in the assembly's through-bore 425 relative to the open ports 432 in the valve 430. In other words, the workstring 410 at the section 428A to be treated is not engaged with seals or seats inside the assembly's through-bore 425 as in previous embodiment.

Without sealing the workstring 410 in the assembly's section 428A, operators apply the treatment down the workstring 410 to treat the borehole annulus 15 for this section 428A. The fluid leaves the ports 412 in the workstring 410 and flows along a first flow path through the open ports 432 of the valve 430 and into the formation around the open section's borehole annulus 15. To maintain the pressure in the assembly 420 during the operation, the system 400 can use a live annulus technique (if the service packer 17 is not used or can be removed, or the system 400 can use a pure squeeze technique with the service packer 17 in the casing 12.

At the same time as the treatment, the closure on the flow device 440 at least prevents fluid flow through the ports 442 and screen 446 from the through-bore 425 to the borehole annulus 15. Preventing the flow out of the screen 446 can be accomplished by either the first or second closure elements 444 and 450 or by both. Preferably, the first closure element 444 also prevents fluid flow from the borehole annulus 15 into the through-bore 425 via the screen 446.

Once treatment of the first section 428A is done, operators reverse out at least some of the excess slurry from the workstring 410 so treatment can commence with the next section 428B. Operators drop the shifter ball (not shown) down the workstring 70 again, and pressure up the workstring 410 to actuate the shifting tools 418*a-b* with the seated ball 414. With the tools 418*a-b* actuated, operators close the open valve 30 for the lower section 428A with the closing tool 418*a*. After bleeding off the pressure, the workstring 410 is raised to the valve 430 in the next section 428B. At this point, operators then pressure up on the seated shifter ball 414 in the workstring 410 again and open this valve 430 with the actuated opening tool 418*b*. After bleeding off the applied pressure in the workstring 410 and reversing out the seated ball 414, the treatment process for this new section 428B is then repeated as before.

Similar procedures are then repeated for all of the subsequent sections (i.e., 428C) of the assembly 420. Once treatment is complete for all of the sections 428A-C, all of the valves 430 and flow device 440 on the assembly 420 are closed. Operators perform a washout operation. To do this, the workstring 410 is lowered down toward the shoe 420 of the assembly 420, and operators pump a washout fluid down the casing 12 to reverse out any residual gravel, proppant or other treatment up the workstring 410. Because all of the valves 430 are closed, operators have no issues with reversing flow for the washout operation.

When washout is complete, operators then open all of the flow devices 440 so their ports 442 communicate with the string's through-bore 425 to accept production. The workstring 410 positions toward the bottom shoe 426, and operators drop the shifter ball 414 again. Pressure is applied to the seated ball 414 to actuate the shifter tools 418*a-b* on the workstring 410, and operators raise the workstring 410 and open the first closure elements 444 (e.g., inner sleeve) of the flow devices 440 up the assembly 420 using the opening tool 418*b*.

As the flow devices 440 are opened, fluid from the borehole annulus 15 can flow along a second flow path through the screens 446, closure elements 450, and opened ports 442. As the flow devices 440 are opened up the assembly 420, the second closure elements 48 (e.g., one-way or check valves) of the flow devices 440 prevent fluid loss from the string's through-bore 425 to the annulus 15 during this process. As shown in FIG. 11B, once all of the flow devices 440 are open, the workstring 410 is removed from the assembly 420. At this point, the assembly 420 is prepared to receive production through the screens 446, closure elements 450, and opened ports 442 via the second flow path.

As can be seen, operation of this system 400 can reduce the time and risk involved in performing the treatment because no service tool needs to seal in the assembly 420. Moreover, pickup and operations time are reduced. Essentially, the workstring 410 can be run in during the liner setting trip so that no added runs are needed. Cleanout and opening/closing of the ports 432 and 442 in the valves 430 and flow devices 440 are all done in the same trip.

The present example of the system 400 is described for an open hole, but the system 400 for a cased hole would be the same except that the isolation packers 429 may be different. Because the system 400 does not use dropped balls in the assembly 420 to open the valve 430 or flow devices 440, the number of stages that can be deployed downhole is not limited by the required step-down sizes in balls and seats. Moreover, no balls or seats are left in the assembly 420 after treatment operations so the operation does not need a separate milling operation, which can be time consuming and can encounter its own issues. In essence, the wellbore is ready to receive production tubing after the operation is completed.

As noted above, in a conventional gravel pack systems, sand slurry is introduced into the annulus uphole of the wellscreens and is circulated downhole (i.e., from heel to toe). The toe-to-heel system as disclosed for example in FIGS. 2A-7 reverses that flow path and introduces the sand slurry into the screen annulus at the toe of the well and circulates it uphole. Further details related to this system are provided in incorporated U.S. application Ser. No. 12/913,981, filed 28 Oct. 2010. The toe-to-heel system of FIGS. 2A-7 is designed so that any excess sand slurry in the workstring can be disposed of downhole in a dedicated annulus in the well. This is so because reverse circulating excess slurry from the workstring with the toe-to-heel system of FIGS. 2A-7 is not practical. In particular, the reverse circulation would require exerting pressure inside the screens and against the formation, and that additional pressure applied to the formation can result in inducing fluid loss into the formation or worse, fracturing the formation. Accordingly, the toe-to-heel system of FIGS. 2A-7 is designed so that any excess sand slurry in the workstring can be emptied downhole in a dedicated annulus in the well.

To allow for reverse circulating, the systems of FIGS. 8 through 11B disclosed above have added pressure holding integrity to the inside of the screens without requiring a separate string of pipe or devices to be run and actuated through intervention. Further details related to this system are provided in incorporated U.S. application Ser. No. 13/670,125, filed 6 Nov. 2012. The systems of FIGS. 8 through 11B still allow for fluid entry so the well can be produced. By extension then, such pressure holding integrity added to the inside of the screens can be included in a toe-to-heel system, such as mentioned above with reference to FIGS. 11A-11B.

To that end, a toe-to-heel system 600 disclosed in FIGS. 12A-12D equips each wellscreen 640 with closure elements 645 (e.g., check valves or the like). During use, the closure elements 645 on the screens 640 prevent fluid flow inside the screens 640 from passing outside the screens 640, but allow fluid flow from outside the screens 640 to pass inside the assembly 620. This allows operators to apply pressure inside the screen liner assembly 620 after gravel packing in order to reverse circulate and remove excess slurry from the workstring 610 after completing a gravel pack.

Figure 12A:
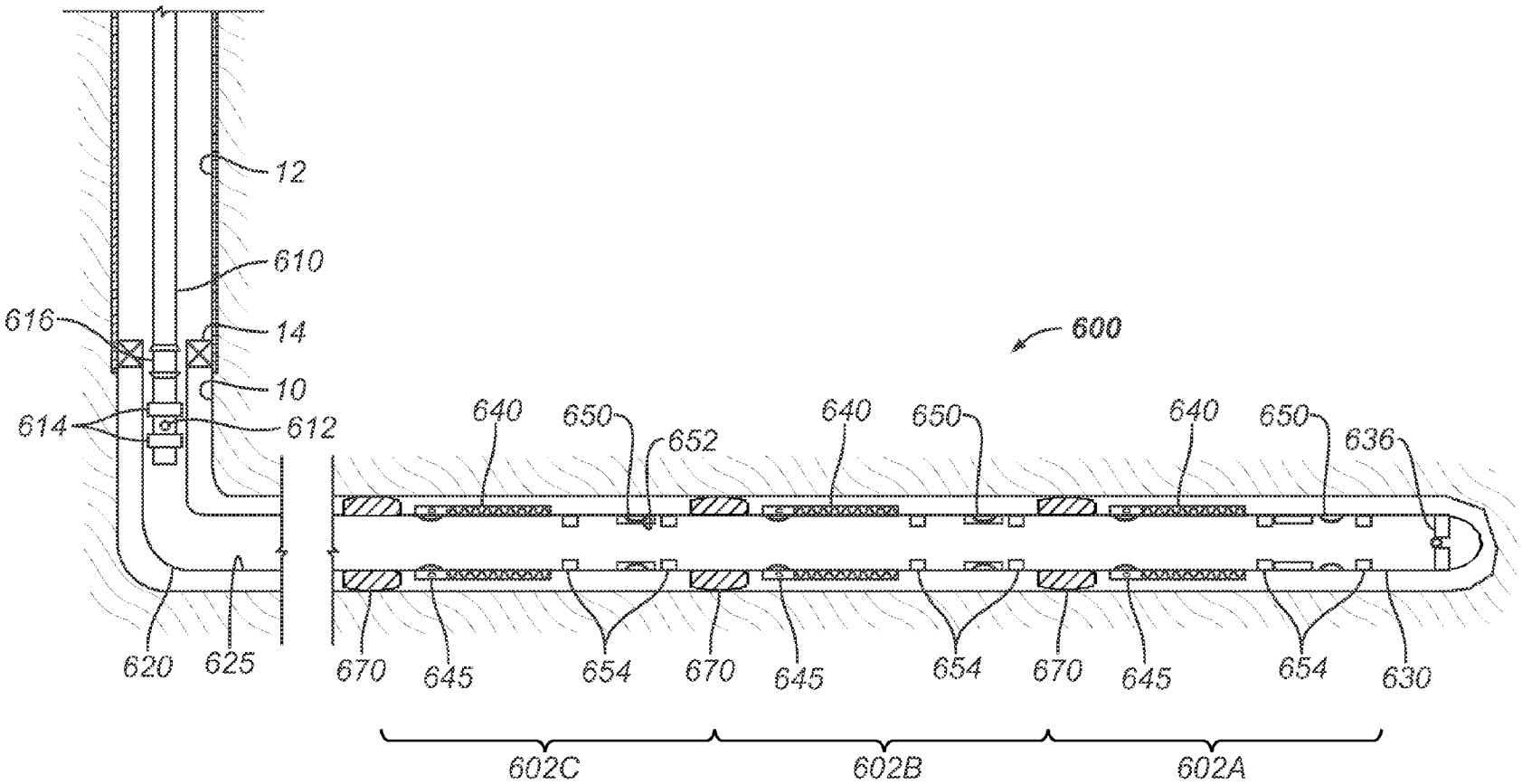
FIGS. 12A-12D illustrate yet another multi-zone screened system according to the present disclosure having a toe-to-heel configuration.

Turning to FIG. 12A, the system 600 includes a packer 14 that sets in the casing 12 above the area of a wellbore to be produced from or injected into. Below the packer 14, a screen liner assembly 620 is spaced out across one or more zones of interest. If there are multiple zones, packers 670 (either open hole or cased hole) are spaced out to isolate one screen section 602A-C from the other. The packers 670 do not require shunts running through them to gravel pack multiple zones, but they could be equipped this way.

The assembly 620 and packers 670 are run downhole in a single trip. This system 600 segments several compartmentalized reservoir zones so that multiple gravel pack operations as well as frac operations can be performed. As shown herein, the system 600 has several gravel pack sections 602A-C separated by packers 670, which seal in the open hole to isolate one zone from another. One or more packers 670 can be used to isolate each of the gravel pack sections 602A-C from one another. Any suitable packers can be used and can include hydraulic packer, hydrostatic packers, and swellable packers, for example. The packers 670 provide zone isolation when set in the borehole 10 to stop the progression of the treatment operations in the isolated zones.

Each section 602A-C can be similar to the systems 200, 300, and 400, as discussed above. Each section 602A-C has a screen 640 and ports 650. The screens 640 include a closure element 645 (e.g., one-way valve, check valves, or the like). Ports 650 adjacent the screens 640 may or may not include valves 652 or selective sleeves.

This system 600 has a workstring 610 that disposes in the assembly 620 to treat (e.g., gravel or frac pack) portions of the formation. As shown, the workstring 610 has external seals 612 disposed near outlet ports 614. A dropped ball 414 can seat in a distal seat of the workstring 610 to divert fluid flow down the workstring 610, out the outlet ports 612, and to the ports 650 in the assembly 620 to treat the surrounding formation. However, other configurations can be used for the workstring 610.

The workstring 610 deploys in the first section 602A and performs washdown by communicating the string's outlet port 612 with the float valve 626 on the float shoe 620 of the system 600. After washdown, the packers 670 are set to create the multiple isolated sections down the borehole annulus 15. The packers 670 can be set hydraulically, hydrostatically, with RFID tags, or with pressure pulses.

Once the packers 670 are set, operators can begin applying a treatment (i.e. fracture, gravel pack, frac-pack, etc.) successively to each of the isolated sections 602A-C. In particular, the string 610 can be selectively positioned at any one of the various sections 602A-C along the system 600. In the selective position, the string's outlet ports 612 with its seals 614 isolate to the flow ports 650 to gravel pack and/or frac pack the annulus 15 around given gravel pack section 602A-C. Then, the inner workstring 610 can be moved so that the outlet ports 612 isolate from these flow ports 650 so reverse circulation can be performed to remove excess slurry from the workstring 610 before moving it to the next gravel pack section 602A-C. A similar process can then be repeated up the hole for each gravel pack section 602A-C separated by the packers 670.

Figure 12B:
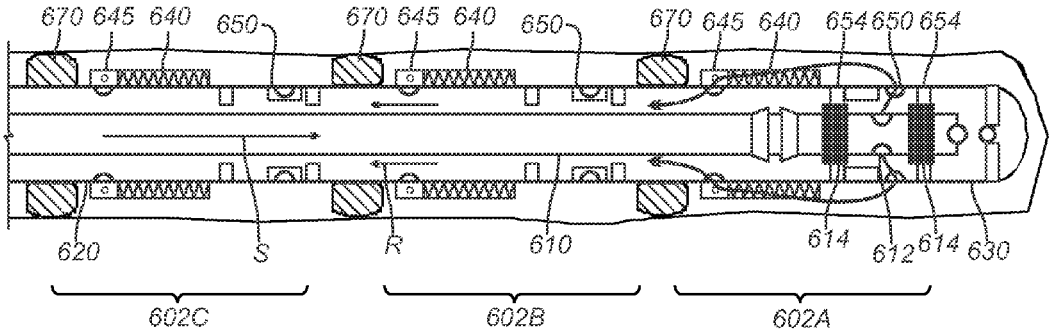
Figure 12C:
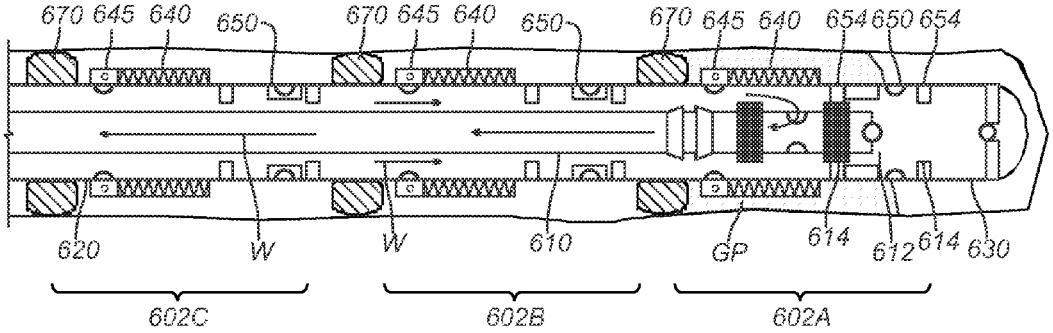
Figure 12D:
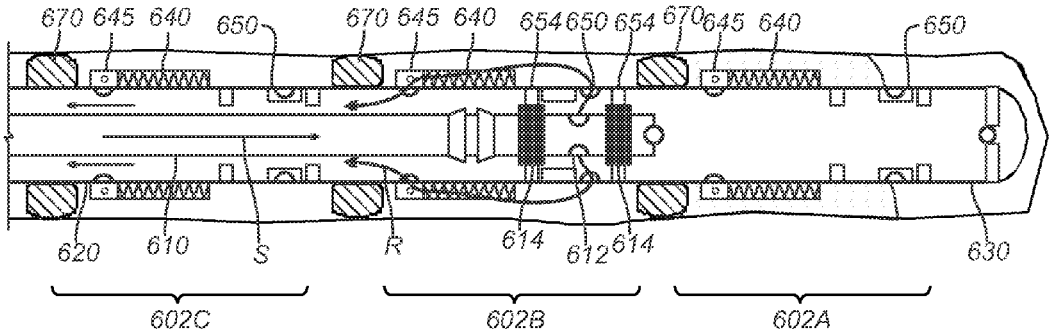

As shown in FIG. 12B in particular, after washdown, the string's outlet ports 612 with its seals 614 isolates to the flow ports 650 to gravel pack and/or frac pack the first gravel pack section 602A. If the flow ports 650 include a valve, then the valve may be opened, for example, by shifting a sleeve open. Slurry communicated down the workstring 610 exits the outlet ports 612 and passes through the section's ports 650 to flow into the isolated annulus of this first section 602A. Gravel from the slurry then gravel packs in the annulus from toe-to-heel as described herein, and fluid returns from the slurry pass through the screen 640 and into the annular space between the liner 630 and the workstring 610. The fluid returns can then flow uphole past the packer 14 to the casing 12 and the surface.

As shown, the ports 650 may have selective valves or sleeves 652 that can be opened with a shifting tool 616 on the workstring 610, although these components may not be necessary in every embodiment. In general, the shifting tool 616 can be a "B" shifting tool for shifting the valve 652 relative to the ports 650. Thus, opening a given valve 652 involves engaging the shifting tool 616 in an appropriate profile of the valve 652 and moving the valve 652 with the workstring 610 to an opened condition so that the assembly's through-bore 625 communicates with the borehole annulus 15 via the now opened ports 650.

As shown in FIG. 12B, the seals 614 on the workstring 610 can engage and seal against inner seats 654, surfaces, seals, or the like at the ports 650 in the assembly 620 on both the uphole and downhole sides. The seals 614 can use elastomeric or other types of seals disposed on the inner workstring 610, and the seats 654 can be polished seats or surfaces inside the assembly 620 to engage the seals 614. Although shown with this configuration, the reverse arrangement can be used with seals on the inside of the assembly 620 and with seats on the workstring 610. Additionally, some embodiments may lack seals and seats altogether and may instead rely on opening and closing the valves 652 on the ports 650 to control fluid flow.

Once the workstring 610 is seated, treatment fluid is flowed down the through-bore of the workstring 610 to the ports 650 at the first zone 602A. The treatment fluid flows through the outlet ports 612 in the workstring 610 and through the ports 650 to the surrounding borehole annulus 15, which allows the treatment fluid to interact with the adjacent zone of the formation. For example, fracture treatment with proppant can be pumped, or gravel in a slurry can be pumped into the annulus.

Gravel packing from toe-to-heel in the system 600 allows fluid returns to pass through the screen 640 and dehydrate the slurry intended to gravel pack the borehole annulus 15 of the sections 602A-C during a gravel or frac pack type of operation. Different from the arrangement in FIG. 9, no separate bypass or tube is needed for fluid returns during the operation. Instead, fluid returns R can flow through the screen 640 and pass through the check valve 645 on the screen 640 and into the through-bore 625 of the assembly 620. As treatment fluid flows from the workstring 610 seated at the ports 650 and into the borehole annulus 15, the wellscreen 640 screens fluid returns from the annulus 15, and the fluid returns can flow into the assembly 620 uphole of the engagement of the workstring 610 in the assembly 620. From this point, the fluid returns can then flow to the surface.

Eventually, sandout will occur when the first section 602A is sufficiently gravel packed. As then shown in FIG. 12C, the workstring 610 can be manipulated to an intermediate position so that the outlet ports 612 communicate inside the screen liner assembly 620. Once treatment is completed for the given zone 602A, operators can manipulate the workstring 610 to engage the shifting tool 616 in the valve 652 to close the ports 650. For example, the shifting tool 616 can engage another suitable profile on the valve 652 to move the valve 652 and close the ports 650.

At this point, the workstring 610 can be moved in the assembly 620 to an intermediate position that allows for excess slurry to be removed from the workstring 610 before moving the workstring 610 to a new zone 602B. As will be appreciated, any excess slurry in the workstring 610 can flow into the assembly 620 while the workstring 610 is manipulated, and any gravel, proppant, sand, or the like in the slurry can cause problems with the workstring 610 sticking, fouling valves, etc.

Therefore, in the intermediate position, the outlet ports 612 on the workstring 610 are exposed to the through-bore 625 of the assembly 620. Reverse circulation can then be pumped down the borehole 12 and into the annular space between the workstring 610 and assembly 620. This clears the excess slurry, which travels back up the workstring 610.

Once reverse circulation is complete, the workstring 610 can be moved in the assembly 620 to another zone 602B to perform treatment. Operators repeat this process up the assembly 620 to treat all of the sections 602A-C. Once the treatment is complete, the system 600 may not need a clean-out trip.

Having the system 600 noted above, gravel packing can be accomplished where the wellscreens 640 are able to be pressurized on the inside. This allows the system 600 to be operated under reverse circulation that exerts pressure inside the assembly 620. Being able to reverse circulation this way makes it possible to perform single zone toe-to-heel gravel packs and subsequently reverse out the excess slurry. The system 600 also makes it possible to perform multiple gravel packs at different points in the wellbore, reversing out after each individual gravel pack operation. The workstring 610 inside the assembly 620 can be positioned at each pumping point in the assembly 620, starting at the lowest point for example, and deliver the gravel pack slurry into the annulus 15, circulating in a toe-to-heel fashion. Once sufficient sand has been pumped, the workstring 610 is repositioned so that pressure applied to the casing 12 and inside the assembly 620 results in reverse circulating of any excess slurry up the workstring 610. Once that slurry has been removed, the workstring 610 is raised to the next pumping location, and the steps are repeated.

The foregoing description of preferred and other embodiments is not intended to limit or restrict the scope or applicability of the inventive concepts conceived of by the Applicants. It will be appreciated with the benefit of the present disclosure that elements of one embodiment can be combined with or exchanged for components of other embodiments disclosed herein. References have been made herein to use of the gravel pack assemblies in boreholes, such as open boreholes. In general, these boreholes can have any orientation, vertical, horizontal, or deviated. For example, a horizontal borehole may refer to any deviated section of a borehole defining an angle of 50-degrees or greater and even over 90-degrees relative to vertical.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A formation treatment method for a borehole, the method comprising:

isolating a borehole annulus of the borehole around an assembly into a plurality of isolated zones, the assembly in each isolated zone having a first port and a screen communicating a through-bore of the assembly with the borehole annulus, the first port having a first closure selectively operable between opened and closed conditions, the screen having a check valve permitting fluid communication from the screen to a second port of the through-bore and preventing fluid communication from the second port to the screen;

positioning a workstring in the through-bore of the assembly; and treating the borehole annulus of any selected ones of the isolated zones by:

opening the first closure at the first port of the selected isolated zone with the workstring;

sealing an outlet of the workstring at the first port of the selected isolated zone;

flowing slurry as a treatment down the workstring, out the outlet, and to the first port;

gravel packing the borehole annulus of the selected isolated zone from toe to heel with gravel in the slurry;

filtering fluid returns of the slurry from the borehole annulus of the selected isolated zone into the through-bore of the assembly through the screen and through the check valve at the second port;

flowing the filtered returns from the selected isolated zone uphole through the through-bore of the assembly by flowing the filtered returns directly from the check valve up the through-bore and preventing flow of the fluid returns in the through-bore from flowing back to the borehole annulus out through the first closures and the check valves of the other isolated zones uphole on the assembly, wherein the filtered returns flow to surface without passing through a bypass of the through-bore; and removing excess of the treatment from the workstring by:

sealing the outlet of the workstring from the open first closure of the first port at the selected isolated zone, reverse circulating down the through-bore of the assembly and into the outlet of the workstring, and preventing the reverse circulation in the through-bore from communicating to the borehole annulus out through the check valve of the selected isolated zone and out through the first closures and the check valves of the other isolated zones.

2. The method of claim 1, comprising initially positioning the assembly in casing having perforations, in an expanded liner having slots, or in an open hole.

3. The method of claim 2, wherein isolating the borehole annulus of the borehole around the assembly into the isolated zones comprises engaging isolation elements on the assembly against a wall of the casing, a wall of the expanded liner, or a wall of the open hole.

4. The method of claim 1, wherein opening the first closure at the first port in the assembly at the selected isolated zone with the workstring comprises shifting a sleeve in the assembly away from the first port with the workstring.

5. The method of claim 1, further comprising closing the first closure at the first port at the isolated zone with the workstring after treatment.

6. The method of claim 1, wherein treating the selected isolated zone comprises:

flowing the slurry as the treatment from the first port disposed toward the toe, gravel packing the annulus of the selected isolated zone from toe to heel, and filtering the fluid returns into the through-bore of the assembly through the screen disposed toward the heel.

7. The method of claim 1, further comprising preparing the isolated zones for production by:

closing the first closures at the first ports of the assembly at the isolated zones with the workstring; and permitting fluid communication from the borehole annulus into the through-bore through the screens, the check valves, and the second ports at the isolated zones.

8. The method of claim 7, further comprising screening production fluid from the borehole annulus of the isolated zones into the through-bore of the assembly through the screens, the check valves, and the second ports.

* * * * *